US010876347B2

(12) United States Patent
Andrus et al.

(10) Patent No.: US 10,876,347 B2
(45) Date of Patent: Dec. 29, 2020

(54) ROTATING DOOR SYSTEMS AND METHODS

(71) Applicant: Apple Inc., Cupertino, CA (US)

(72) Inventors: James Andrus, San Francisco, CA (US); Ed Wright, San Jose, CA (US); James McGrath, Cupertino, CA (US); Marco Albertini, Costa Mesa, CA (US); Brent Gordon, San Diego, CA (US); Hilton Perry, Encinitas, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 15/197,363

(22) Filed: Jun. 29, 2016

(65) Prior Publication Data

US 2017/0002604 A1 Jan. 5, 2017

Related U.S. Application Data

(60) Provisional application No. 62/187,746, filed on Jul. 1, 2015.

(51) Int. Cl.
*E06B 3/40* (2006.01)
*E05F 15/611* (2015.01)
(Continued)

(52) U.S. Cl.
CPC ..... *E06B 3/40* (2013.01); *E05F 15/611* (2015.01); *E06B 1/38* (2013.01); *E05F 15/70* (2015.01);
(Continued)

(58) Field of Classification Search
CPC ..... E06B 3/40; E06B 3/90; E06B 2003/406; E06B 3/02; E05F 2017/008
See application file for complete search history.

(56) References Cited

U.S. PATENT DOCUMENTS 2,043,472 A 6/1936 Eager et al.
D149,775 S 5/1948 Rubaloff
(Continued)

FOREIGN PATENT DOCUMENTS

GB 905685 A * 9/1962 ..... E05D 15/0604

OTHER PUBLICATIONS https://www.designboom.com/architecture/edaa-casa-meztitla-mexico-04-18- 2016/, date Apr. 2016.*
(Continued)

*Primary Examiner* — Catherine A Kelly
(74) *Attorney, Agent, or Firm* — Sterne, Kessler, Goldstein & Fox P.L.L.C.

(57) ABSTRACT

Rotating door systems and methods for rotating a plurality of rotatable doors between a closed position and an open position are provided. Each of the rotatable doors may have a height measured in a vertical direction between opposing horizontal edges, a width measured in a horizontal direction between opposing vertical edges, and an axis of rotation centrally located between the opposing vertical edges. The rotatable doors may be rotatably coupled to an upper support at the axis of rotation via an upper pivot shaft and rotatably coupled to a lower support at the axis of rotation via a lower pivot shaft. The rotatable doors may be at least partially transparent. The rotation of one or more of the rotatable doors may be controlled by a controller.

37 Claims, 15 Drawing Sheets

(51) Int. Cl.
*E06B 1/38* (2006.01)
*E05F 15/70* (2015.01)

(52) U.S. Cl.
CPC ... *E05Y 2900/132* (2013.01); *E06B 2003/406* (2013.01)

(56) References Cited

U.S. PATENT DOCUMENTS 2,888,718 A * 6/1959 Gilles-Joseph Francotte ..... E06B 3/12 49/504
3,169,329 A 2/1965 Powers
D212,742 S 11/1968 Long
D222,854 S 1/1972 Weiss
3,897,651 A 8/1975 Sheckells
D239,382 S 3/1976 Moscatelli
4,078,333 A * 3/1978 Lussier ..... E05B 65/102 49/141
D254,032 S 1/1980 Broudy
4,562,665 A 1/1986 Blackston
4,627,193 A * 12/1986 Schwarz ..... E05G 5/003 49/31
4,660,322 A * 4/1987 Lowe ..... E05D 15/02 49/44
5,332,279 A 7/1994 Golemis et al.
5,770,934 A * 6/1998 Theile ..... H02H 7/0851 318/466
5,789,887 A * 8/1998 Elischewski ..... G05B 19/0428 318/286
5,927,016 A * 7/1999 Borgen ..... E05F 17/004 49/123
6,084,367 A * 7/2000 Landert ..... E05F 15/70 318/283
6,481,160 B1 * 11/2002 Kowalczyk ..... E05F 3/224 49/333
6,532,699 B1 3/2003 Franklin et al.
D559,403 S 1/2008 Vils
7,571,896 B2 8/2009 Bonham
8,181,311 B2 * 5/2012 Chiang ..... E05F 3/104 16/56
D671,573 S 11/2012 Behr
D712,067 S 8/2014 Backus et al.
D720,082 S 12/2014 O'Callaghan et al.
D723,185 S 2/2015 Moyer et al.
D726,334 S 4/2015 O'Callaghan et al.
D759,220 S 6/2016 van Doorn
D771,836 S 11/2016 Siegel et al.
D782,700 S 3/2017 Rauta et al.
D785,202 S 4/2017 Lee et al.
D794,218 S 8/2017 Fisher
9,719,282 B2 8/2017 Bellei
D797,265 S 9/2017 Pham et al.
D797,305 S 9/2017 Peak et al.
D871,612 S 12/2019 Siegel et al.
10,508,441 B2 12/2019 Kopish et al.
2011/0126471 A1 6/2011 Hans
2015/0135596 A1 * 5/2015 Cooper ..... A62C 2/10 49/420
2016/0309919 A1 * 10/2016 Giulietti ..... E05F 17/004

OTHER PUBLICATIONS http://applestorefronts.appspot.com/—Store Opened Jan. 28, 2006.
"Dark skinned light flooded lake house in Nevada" [online]. freshome.com. Allegedly published Jan. 17, 2012. Retrieved from the Internet: http://freshome.com/2012/01/17 /dark-skinned-light-flooded-lake-house-in-nevada.
"Madison House/ XTEN Architecture" [online]. archdaily com. Allegedly published on May 30, 2013. Retrieved from the Internet: <http://www.archdaily.com/378881/ madisonhousextenarchitecture>.
Photograph 1: Photograph believed taken before Feb. 6, 2015.
Photograph 2: Photograph believed taken before Feb. 6, 2015.
Photograph 3: Photograph believed taken before Feb. 6, 2015.
"Minimal glass pivot doors" [online]. portapivot.com. Retrieved Jan. 22, 2020. Retrieved from the Internet: <https://www.portapivot.com/pages/portapivot-glass>.

* cited by examiner

ROTATING DOOR SYSTEMS AND METHODS

CROSS-REFERENCE TO RELATED APPLICATION(S)

This application claims priority to U.S. Provisional Application No. 62/187,746, filed on Jul. 1, 2015, which is incorporated herein in its entirety by reference thereto.

FIELD

The described embodiments relate generally to rotating door systems and methods. More particularly, the present embodiments relate to rotating door systems and methods for opening and closing a doorway, for example, a storefront.

BACKGROUND

A business owner (e.g., a retailer) may desire a way of allowing individuals to enter a building (e.g., a store).

SUMMARY

A business owner (e.g., a retailer) may wish to invite individuals (e.g., customers) into a building or establishment (e.g., a store) in an aesthetically appealing and inviting way. At the same time, the business owner may wish to prevent entry into the building during specific times of the day (e.g., when the building is closed for business). To do this, the business owner may employ one or more rotatable doors to allow individuals to enter the building at certain times and prevent entry during other times.

An aesthetically appealing and inviting doorway for a building or establishment may be an important tool for attracting business. For example, an aesthetically appealing and inviting storefront for a retail store may, among other things, be an important tool for attracting customers to the store. An aesthetically appealing an inviting storefront may encourage new customers to visit the store, create brand recognition, increase customer awareness of the store, and/or encourage repeat customers to visit the store. Moreover, a storefront that is aesthetically appealing even when the store is closed may be an important tool for enticing new and repeat customers to visit the store and creating brand recognition. In some cases, a storefront that allows customers to view the interior of store when the store is closed increases customer awareness of the products for sale within the store.

Moreover, controlling the time and manner in which individuals enter a building may be desirable for crowd control. In some instances, automatic control of the time and manner in which individuals enter a building may be desirable.

To accomplish these and other objectives, the business owner may use a rotating door system and/or method, or elements thereof, according to embodiments described herein.

Some embodiments are directed towards a rotating door system. In some embodiments, the rotating door system may include a plurality of rotatable doors configured to rotate between a closed position and an open position, each of the rotatable doors having a height measured in a vertical direction between opposing horizontal edges, a width measured in a horizontal direction between opposing vertical edges, and an axis of rotation centrally located between the opposing vertical edges. In some embodiments, each of the rotatable doors may be rotatably coupled to an upper support at the axis of rotation via an upper pivot shaft and rotatably coupled to a lower support at the axis of rotation via a lower pivot shaft. In some embodiments, at least a portion of each of the rotatable doors may be transparent.

In some embodiments, when rotating between the closed position and the open position, the rotatable doors may automatically rotate at the same time. In some embodiments, when rotating between the closed position and the open position, the rotatable doors may automatically rotate at the same speed. In some embodiments, when rotating between the closed position and the open position, each of the plurality of rotatable doors may automatically rotate at a variable speed between the closed position and the open position. In some embodiments, the speed of rotation increases as the rotatable doors rotate away from the closed position, reaches a maximum between the closed position and the open position, and decreases as the rotatable doors approach the open position.

In some embodiments, when rotating between the closed position and the open position, a first rotatable door may automatically rotate clockwise and a second rotatable door may automatically rotate counter-clockwise. In some embodiments, the first rotatable door may be located immediately adjacent to the second rotatable door. In some embodiments, the first rotatable door and the second rotatable door may rotate simultaneously.

In some embodiments, rotatable doors immediately adjacent to each other may be spaced apart in the closed position. In some embodiments, the plurality of rotatable doors do not overlap in the closed position. In some embodiments, vertical edges of the rotatable doors may be aligned in same horizontal plane in the closed position.

In some embodiments, each of the rotatable doors may include a transparent glass panel. In some embodiments, each of the rotatable doors may have a height of at least 8 feet and a width of at least 6 feet.

In some embodiments, each of the rotatable doors may include a peripheral border, the peripheral border defining the horizontal edges, the vertical edges, and a border around the periphery of front and rear surfaces of the rotatable door. In some embodiments, the upper pivot shaft and the lower pivot shaft of each rotatable door may be coupled to the peripheral border of the rotatable door.

In some embodiments, the rotating door system may include a controller configured to control the rotation of the rotatable doors. In some embodiments, the rotating door system may include a sensor in communication with the controller and the controller may be configured to control the rotation of the rotatable doors based on signals received from the sensor.

In some embodiments, the rotating door system may include a plurality of gear assemblies, each coupled to the upper pivot shaft or the lower pivot shaft of one of the rotatable doors, a plurality of actuators, each coupled to and configured to rotate a gear assembly, and a controller configured to control the rotation of the rotatable doors by operating the actuators.

Some embodiments are directed towards a store. In some embodiments, the store includes a plurality of rotatable doors configured to rotate between a closed position and an open position, each of the rotatable doors having a height measured in a vertical direction between opposing horizontal edges, a width measured in a horizontal direction between opposing vertical edges, and an axis of rotation centrally located between the opposing vertical edges. In some embodiments, each of the rotatable doors may be rotatably coupled to an upper support at the axis of rotation via an upper pivot shaft and rotatably coupled to a lower support at the axis of rotation via a lower pivot shaft. In some embodiments, at least a portion of each of the rotatable doors may be transparent.

In some embodiments, the store may include a controller configured to control the rotation of the rotatable doors between the closed position and the open position. In some embodiments, the store may include a controller configured to control the rotation of the rotatable doors between the closed position and the open position, and a sensor in communication with the controller, where the controller is configured to prevent or stop rotation of one or more of the rotatable doors in response to receiving a signal from the sensor. In some embodiments, the store may include a user input in communication with the controller for receiving a user command to rotate the rotatable doors from the closed position to the open position and vice versa.

In some embodiments, the store may include a controller configured to control the rotation of the rotatable doors between the closed position and the open position, wherein the controller is configured to rotate each door having an axis of rotation located on the right side of the plurality of rotatable doors in a first rotational direction and to rotate each door having an axis of rotation located on the left side of the plurality of rotatable doors in a second rotational direction opposite the first rotational direction, the right and left side being relative to a point of view from outside the store. In some embodiments, the first rotational direction is clockwise viewed from above, and the second rotational direction is counter-clockwise viewed from above.

Some embodiments are directed towards a rotating door assembly. In some embodiments, the rotating door assembly may include a panel door having a height measured in a vertical direction between opposing horizontal edges, a width measured in a horizontal direction between opposing vertical edges, and an axis of rotation centrally located between the opposing vertical edges. The rotating door assembly may include an upper support beam having an upper support assembly at least partially disposed in an opening formed in the upper support beam, the upper support assembly including an upper pivot shaft coupled to the panel door at the axis of rotation, an alignment plate coupling the upper pivot shaft to the upper support beam, a gear assembly coupled to the upper pivot shaft, and an actuator coupled to the gear assembly and configured to rotate the rotatable door. In some embodiments, the rotating door assembly may include a lower support assembly having a lower pivot shaft coupled to the panel door at the axis of rotation, the lower pivot shaft including a first end coupled to the panel door and a second end coupled to a bearing plate, a support plate coupled to the lower support beam, and a gimbal plate disposed between the bearing plate and the support plate aligning and securing the bearing plate on the support plate.

In some embodiments, the gimbal plate may include an alignment block configured to align the center axes of the lower pivot shaft and the upper pivot shaft, and the support plate may include an alignment block configured to align the center axes of the lower pivot shaft and upper pivot shaft. In some embodiments, the alignment blocks may include at least one alignment block configured to allow the bearing plate to be moved in a first horizontal direction and at least one alignment block configured to allow the bearing plate to be moved in a second horizontal direction different from the first.

In some embodiments, the panel door may include a body and a peripheral border defining the horizontal edges, the vertical edges, and a border around a periphery of front and rear surface of the rotatable doors. In some embodiments, the upper pivot shaft and the lower pivot shaft may be coupled to the peripheral border, and the upper pivot shaft and the lower support shaft do not extend through the peripheral border.

In some embodiments, the body of the panel door may include a transparent panel. In some embodiments, the body of the panel door may include a glass panel.

Some embodiments are directed towards a method of opening a doorway. In some embodiments, method may include receiving a signal to open the doorway at a processor of a controller, and in response to receiving the signal, the controller may control at least one motor to simultaneously rotate a plurality rotatable doors defining at least a portion of the doorway about their respective axes of rotation, where each door having an axis of rotation located on the right side of the plurality of rotatable doors rotates in a first rotational direction and each door having an axis of rotation located on the left side of the plurality of rotatable doors rotates in a second rotational direction opposite the first rotational direction.

In some embodiments, the speed of rotation of the rotatable doors may be the same.

In some embodiments, the speed of rotation of the rotatable doors may follow a variable speed pattern and each of the rotatable doors may follow the same variable speed pattern. In some embodiments, the variable speed pattern may have a bell-shaped pattern starting at a speed of zero when the rotatable doors are in a closed position, increasing in speed as the rotatable doors rotate away from the closed position, reaching a maximum speed between the closed position and the open position, decreasing in speed as the rotatable doors approach the open position, and returning to a speed of zero when the rotatable doors reach the open position.

BRIEF DESCRIPTION OF THE DRAWINGS

The disclosure will be readily understood by the following detailed description in conjunction with the accompanying drawings, wherein like reference numerals designate like structural elements, and in which.

DETAILED DESCRIPTION

Figure 1:
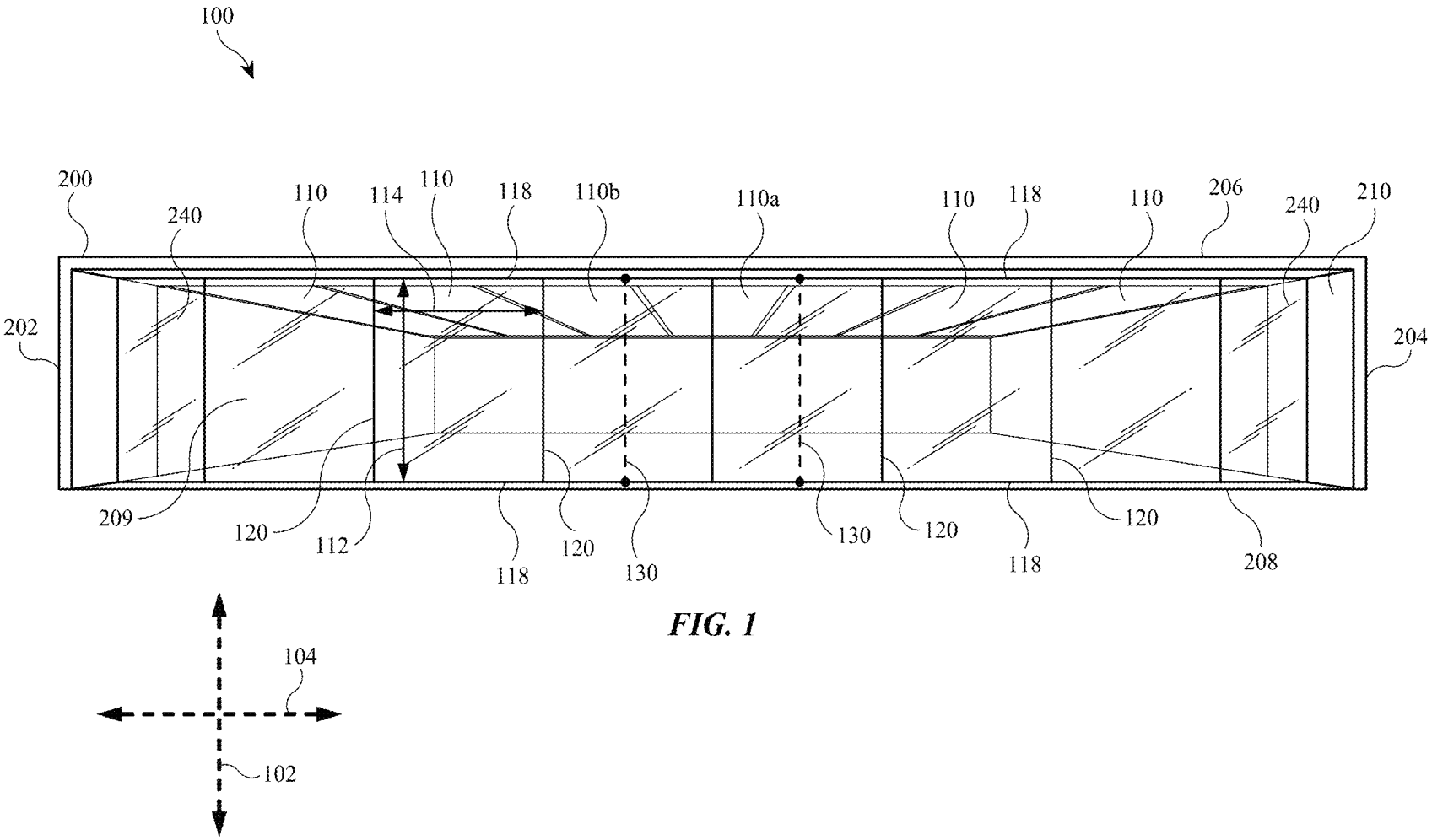
FIG. 1 shows a front view of a rotating door system in a closed position according to an embodiment.

Reference will now be made in detail to representative embodiments illustrated in the accompanying drawings. It should be understood that the following descriptions are not intended to limit the embodiments to one preferred embodiment. To the contrary, it is intended to cover alternatives, modifications, and equivalents as can be included within the spirit and scope of the described embodiments as defined by the claims.

References to "one embodiment," "an embodiment," "some embodiments," "an exemplary embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

An aesthetically appealing and inviting doorway for a building may attract positive attention to the building, thereby increasing its status and/or recognition within a community. In some instances, it may be an important tool for attracting business. But, while an aesthetically appealing storefront may be desirable, there may be other important considerations, for example, crowd control. A doorway that individuals intuitively enter and exit may be an effective tool for crowd control. Moreover, the impression a storefront gives and/or attention the storefront garners may be a consideration. For example, in a retail situation, a storefront that focuses customer attention on the products within the store, rather than on the storefront itself may be desirable. A storefront that customers intuitively enter and exit may focus their attention on the store's products rather than the storefront itself. In some instances, automatic control of the time and manner in which individuals enter a building may be desirable.

As described, embodiments of the present invention relate to rotating door systems and methods for opening and closing a doorway, such as a storefront. The rotating door system may include one or more rotatable doors configured to rotate about respective axes of rotation. In some embodiments, the axis of rotation of a rotatable door may be centrally located between opposing vertical edges of the door such that it rotates symmetrically about the axis of rotation. The one or more rotatable doors may be configured to rotate clockwise and/or counter-clockwise to allow individuals to enter a building or establishment (e.g., a store).

In some embodiments, a rotating door system may include a plurality of rotatable doors configured to open inwardly towards a geometrical center of a building or establishment, or a geometrical center of a portion of the building or establishment (e.g., a lobby or particular room). Rotatable doors configured to rotate inwardly may exude an inviting appearance to individuals outside the building or establishment. In some embodiments, the rotating door system may include a plurality of rotatable doors configured to open by rotating at the same time and/or speed.

In some embodiments, the rotation of one or more rotatable doors may be controlled by a controller. The controller may coordinate (e.g., synchronize) the rotational movements of one or more rotatable doors. In some embodiments, the controller may receive a signal from one or more devices (e.g., user inputs or sensors) to control the rotational movements of one or more rotatable doors. These signals may be used to open the rotatable doors, close the rotatable doors, stop rotation the rotatable doors, prevent the rotation of the rotatable doors, etc. In some embodiments, the controller may control the rotation of one or more rotatable doors by controlling the operation of one or more actuators associated with one or more of the rotatable doors. Automatic control of one or more rotatable doors may be an appealing and effective method for opening and closing a doorway.

In some embodiments, one or more rotatable doors may be at least partially transparent. Rotatable doors that are at least partially transparent may allow an individual to see through a doorway when the rotatable doors are in a closed position, thereby still providing an inviting appearance even while preventing access to an area. This may be desirable in cases where a business owner would like an individual to have a clear view of the inside of a building, establishment, store, room, etc. when the doors are closed. For example, it may be desirable for a store to include a storefront that allows potential customers to view products for sale within the store when the store is closed.

In some embodiments, a rotatable door may be rotatably supported about its axis of rotation by an upper support assembly and a lower support assembly. In some embodiments, a rotatable door may be rotatably coupled to an upper support at its axis of rotation via an upper pivot shaft of an upper support assembly. In some embodiments, a rotatable door may be rotatably coupled to a lower support at its axis of rotation via a lower pivot shaft of a lower support assembly. Upper and lower support assemblies may include one or more alignment features for vertically aligning an upper pivot shaft and a lower pivot shaft such that a rotatable door will properly rotate about its intended axis of rotation (e.g., symmetrically rotate about the axis of rotation). Non-symmetrical rotation may create undesirable stresses on a rotatable door, which may result in increased maintenance costs.

These and other embodiments are discussed below with reference to the figures. However, those skilled in the art will readily appreciate that the detailed description given herein with respect to these figures is for explanatory purposes only and should not be construed as limiting.

Embodiments of the present invention include a rotating door system 100 for opening and closing a doorway, such as a storefront. Rotating door system 100 may include one or more rotatable doors 110 each defined by two opposing horizontal edges 118, two opposing vertical edges 120, a front surface 122, and a back surface 124. As shown in FIG. 1, each rotatable door 110 has a height 112 measured in a vertical direction 102 between opposing horizontal edges 118 and a width 114 measured in a horizontal direction (e.g., direction 104) between opposing vertical edges 120. In some embodiments, rotating door(s) 110 may have an axis of rotation 130 centrally located between opposing vertical edges 120. In this manner, rotatable door(s) 110 may rotate symmetrically about axis of rotation 130.

Rotatable doors 110 may rotate been a closed position (FIG. 1) and an open position (FIG. 2) to open and close a doorway. In some embodiments, the closed position and the open position differ by 90 degrees of rotation of rotatable doors 110. In some embodiments, rotatable doors 110 may automatically rotate between the closed position and the open position. Each rotatable door 110 may rotate in a clockwise direction or a counter-clockwise direction from the closed position to the open position. Also, each rotatable door 110 may rotate in a clockwise direction or a counter-clockwise direction from the open position to the closed position. In some embodiments, one or more rotatable doors 110 in rotating door system 100 may rotate in a clockwise direction when rotating from the closed position to the open position. In some embodiments, one or more rotatable doors 110 in rotating door system 100 may rotate in a counter-clockwise direction when rotating from the closed position to the open position. Similarly, in some embodiments, one or more rotatable doors 110 in rotating door system 100 may rotate in a clockwise direction when rotating from the open position to the closed position. And, in some embodiments, one or more rotatable doors 110 in rotating door system 100 may rotate in a counter-clockwise direction when rotating from the open position to the closed position. In some embodiments, one or more rotatable doors 110 in rotating door system 100 may rotate between the open position and the closed position by rotating in a first direction (e.g., clockwise) when rotating from the closed position to the open position and rotate in the opposite direction (e.g., counter-clockwise) when rotating from the open position to the closed position.

In some embodiments, the rotational movement of one or more rotatable doors 110 in rotating door system 100 may be the same, in whole or in part. In some embodiments, multiple rotatable doors 110 may rotate at the same time. In some embodiments, multiple rotatable doors 110 may rotate at the same speed(s). In some embodiments, multiple rotatable doors 110 may rotate at the same speed(s) at the same time. For example, multiple rotatable doors 110 may begin rotating from the closed position at the same time, rotate at the same speed(s), and arrive at the open position at the same time, and vice versa.

In some embodiments, one or more rotatable doors 110 may rotate at a variable speed between the closed position and the open position (including from the open position to the closed position and from the closed position to the open position). In some embodiments, the speed of rotation increases as rotatable door(s) 110 rotates away from the closed (or open) position, reaches a maximum between the closed position and the open position, and decreases as rotatable door(s) 110 approaches the open (or closed) position. In some embodiments, one or more rotatable doors 110 may rotate at a variable speed having a bell-shaped speed pattern. The bell-shaped pattern may start at a speed of zero when a rotatable door 110 is in the closed (or open) position, increase in speed as rotatable door 110 rotates away from the closed (or open) position, reach a maximum speed between the closed position and the open position, decrease in speed as rotatable door 110 approaches the open (or closed) position, and return to a speed of zero when rotatable door 110 reaches the open (or closed) position.

The rotational speed, direction, and timing of rotatable doors 110 may be tailored to provide desired visual and practical effects for a doorway. In some embodiments, multiple rotatable doors may rotate simultaneously. In some embodiments, multiple rotatable doors 110 may rotate simultaneously and in synchronization (i.e., with a timed relationship among the multiple rotatable doors 110, e.g., rotating with the same or opposing movement at the same time). In some embodiments, the multiple rotatable doors 110 remain parallel throughout their rotations between the open position and the closed position. In some embodiments, one or more rotatable doors 110 may rotate sequentially (e.g., a right-most door may start its rotation, then the door immediately adjacent to the right-most door may start its rotation, and so on in order throughout the remaining rotatable doors 110; or outermost (or innermost) rotatable doors 110 may start their rotation simultaneously, followed sequentially by the next-outermost (or innermost) rotatable doors 110 throughout the remaining rotatable doors 110).

In some embodiments, one or more rotatable doors 110 may rotate independent of the rotational timing and/or direction of other rotatable doors 110. In some embodiments, each of the rotatable doors 110 in rotating door system 100 may rotate in the same rotational direction. In some embodiments, at least one of the rotatable doors 110 in rotating door system 100 rotates clockwise and at least one of the rotatable doors 110 in rotating door system 100 rotates counter-clockwise. In some embodiments, at least one of the rotatable doors 110 in rotating door system 100 rotates clockwise and least one of the rotatable doors 110 in rotating door system 100 rotates counter-clockwise simultaneously. In some embodiments, a first rotatable door 110 in rotating door system 100 (e.g., rotatable door 110*a*) rotates clockwise and a second rotatable door in rotating door system 100 (e.g., rotatable door 110*b*) located immediately adjacent to the first rotatable door rotates counter-clockwise (see e.g., FIG. 3). In some embodiments, the first rotatable door (e.g., 110*a*) and the second rotatable door (e.g., 110*b*) may rotate simultaneously.

As shown in FIG. 1, vertical edges 120 of two or more rotatable doors 110 may be aligned in horizontal direction 104 when in the closed position (i.e., arranged side-by-side). In some embodiments, rotatable doors 110 located immediately adjacent to each other in rotating door system 100 may be spaced apart in the closed position. In some embodiments, rotatable doors 110 in rotating door system 100 do not overlap with each other in the closed position. In some embodiments, the rotatable doors 110 in rotating door system 100 may be aligned in the same plane (e.g., a horizontal plane in horizontal direction 104) in the closed position. In some embodiments, a vertical edge 120 of a first rotatable door 110 is spaced apart from a vertical edge 120 of a second rotatable door 110 disposed immediately adjacent to the vertical edge 120 of the first rotatable door 110 when the two rotatable doors 110 are in the closed position.

Figure 2:
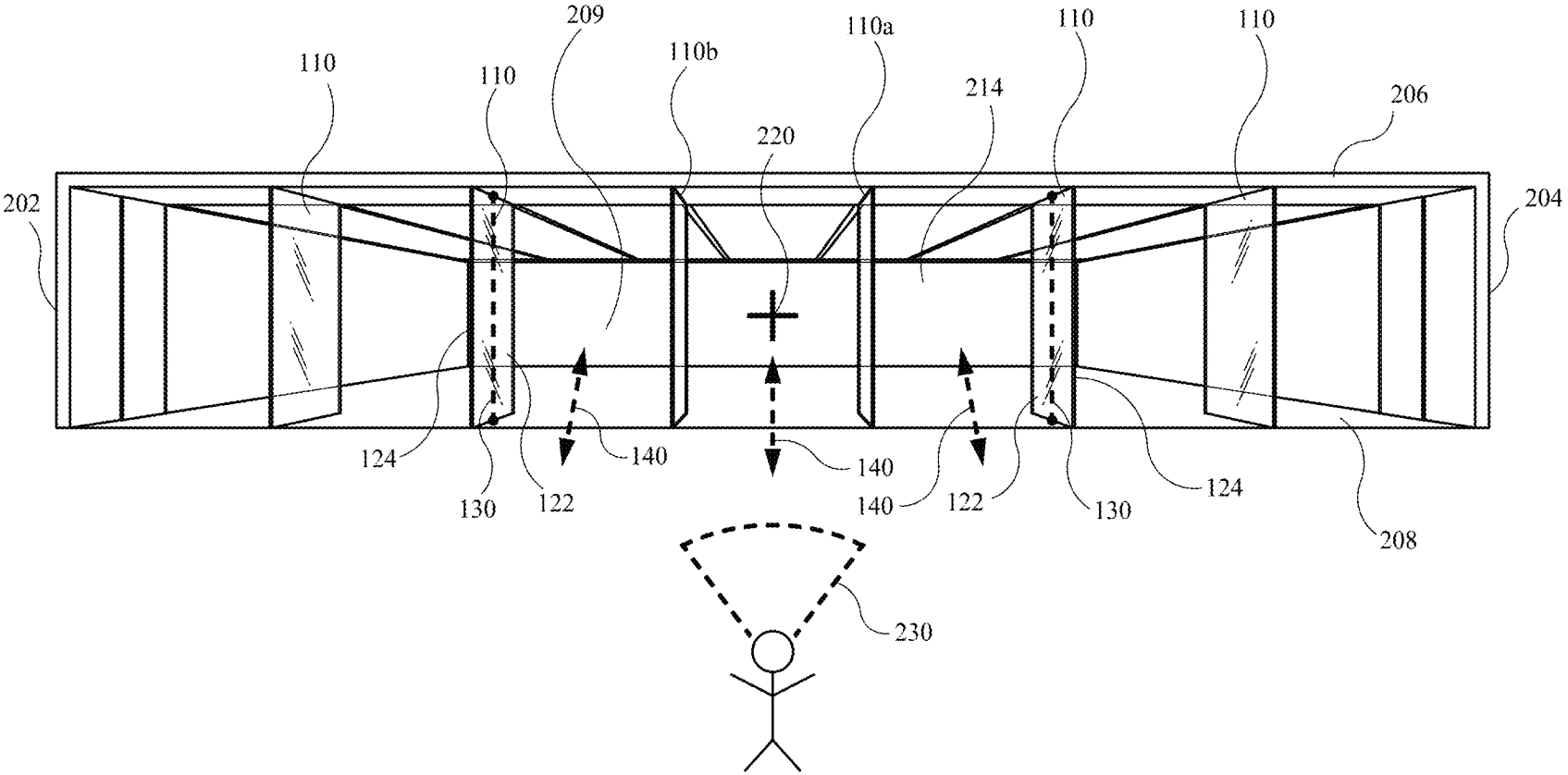
FIG. 2 shows a front view of a rotating door system in an open position according to an embodiment.

As shown in FIG. 2, front and back surfaces 122/124 of individual rotatable doors 110 in rotating door system 100 may be arranged parallel to front and back surface 122/124 of other rotatable doors 110 in horizontal direction 104 and in a spaced apart relationship (i.e., arranged on parallel vertical planes perpendicular to horizontal direction 104). In embodiments where axis of rotation 130 is centrally located between opposing vertical edges 120 of each rotatable door 110, each rotatable door 110 may be spaced apart from its neighbor(s) by a distance substantially equal to width 114 of a rotatable door 110.

In some embodiments, rotatable doors 110 may be panel doors defined by opposing horizontal edges 118, opposing vertical edges 120, a front surface 122, and a back surface 124. In some embodiments, one or more rotatable doors 110 may include a transparent portion defining at least a portion of front surface 122 and back surface 124. In this manner, one or more rotatable doors 110 may be see-through. In some embodiments, rotatable doors 110 may include a transparent panel defining at least a portion of front surface 122 and back surface 124. In some embodiments, one or more rotatable doors 110 may include a plurality of glass panels defining at least a portion of front surface 122 and/or back surface 124. In some embodiments, one or more rotatable doors 110 may include a plurality of stacked transparent panels, with one panel defining at least a portion of front surface 122 and one panel defining at least a portion of back surface 124 (see e.g., panels 452 in FIG. 8).

Transparent materials for rotatable doors 110 include, but are not limited to, glass, glass ceramics, polymers (e.g., polycarbonate and Poly(methyl methacrylate)), and combinations thereof. In some embodiments, the transparent material may be a treated or laminated glass (e.g., a tempered or shatterproof glass). In some embodiments, one or more rotatable doors 110 may include a six-sided transparent panel. In some embodiments, one or more rotatable doors 110 may include color-changing or transparency-changing material (e.g. electrochromic glass or polymer dispersed liquid crystals).

Rotatable doors 110 may be sized and shaped to span across all or a portion of a doorway (e.g., a storefront or other entrance, such as a room or area entrance). Moreover, rotating door system 100 may include any number of rotatable doors 110 sized and shaped accordingly to span across all or a portion of a doorway. In some embodiments, rotating door system 100 may include at least four rotatable doors 110. In some embodiments, rotatable doors 110 may extend from the lowest boundary (e.g., floor) of the storefront or building doorway to the highest boundary (e.g., a ceiling or upper limit of a doorway cutout in a wall) of the storefront or building doorway. In some embodiments, one or more of the rotatable doors 110 may have a height 112 of at least 8 feet and a width 114 of at least 6 feet. In some embodiments, one or more of the rotatable doors 110 may have a height 112 of at least 10 feet and a width 114 of at least 8 feet. In some embodiments, one or more of the rotatable doors 110 may have a height 112 of approximately 12 feet and a width 114 of approximately 10 feet. Such scale may be particularly useful for a retail storefront. In some embodiments, each of the rotatable doors 110 in rotating door system 100 may have the same dimensions. In some embodiments, the dimensions of one or more rotatable doors 110 in rotating door system 100 may be different.

While FIGS. 1 and 2 show rotatable doors 110 having a flat rectangular shape, rotatable doors 110 may have other shapes including, but not limited to, a square shape, a rectangular or square shape with rounded or tapered horizontal edges 118 and/or rounded or tapered vertical edges 120, or a rectangular or square shape with a rounded front surface 122 and/or a rounded back surface 124. In some embodiments, the shape of rotatable doors 110 may be tailored so as to match the exterior shape of storefront, building, or other structure. For example, rotatable doors 110 may be curved (e.g., to match the curve of a doorway), and may include curved glass panels.

Figure 3:
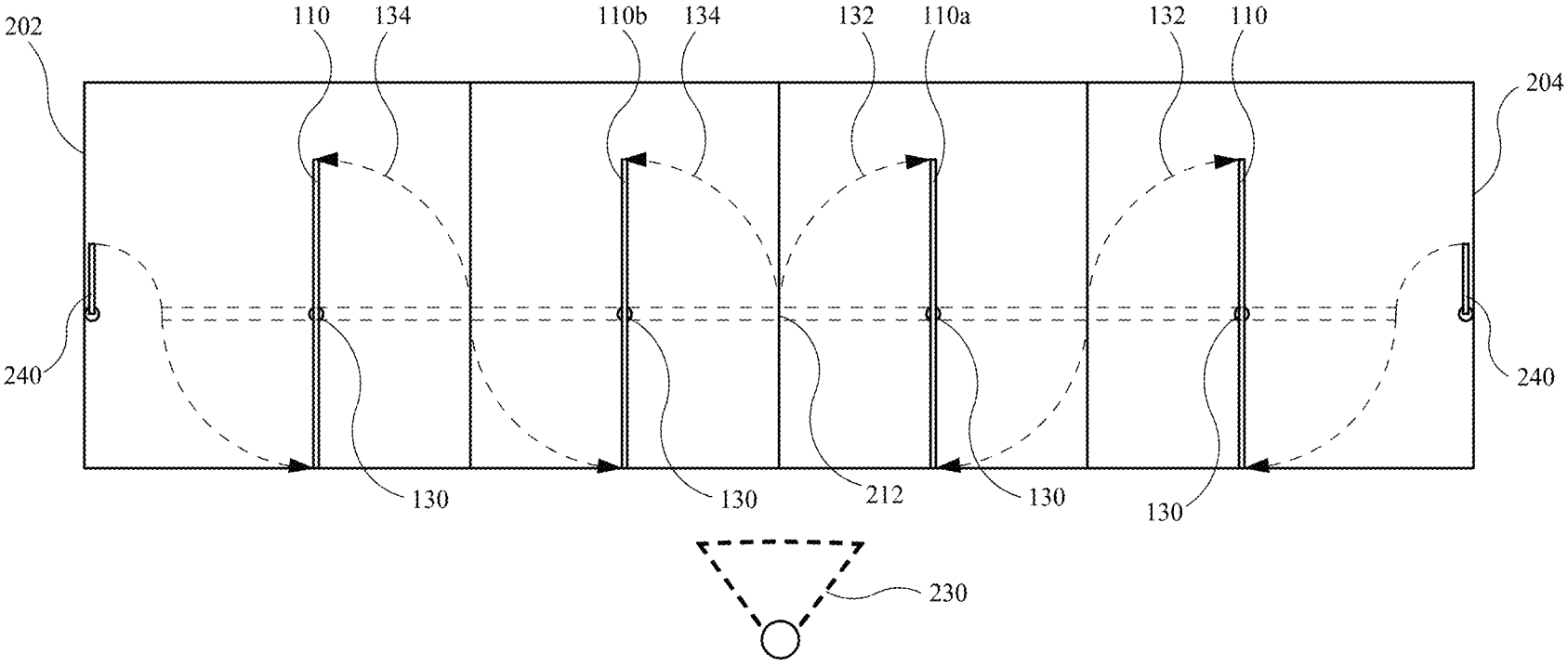
FIG. 3 shows a top view of a rotating door system in an open position according to an embodiment.

As an exemplary embodiment, FIGS. 1-3 show rotating door system 100 including a plurality of rotatable doors 110 defining a portion of a storefront 210 of a store 200. As shown in FIGS. 1-2, store 200 includes a left side wall 202, a right side wall 204, a ceiling 206, a floor 208, and rear side 214 defining store 200 and an interior volume 209 of store 200. In a closed position (FIG. 1), rotatable doors 110 may be arranged side-by-side and aligned in a horizontal direction (e.g., direction 104) across at least a portion of storefront 210. In some embodiments, rotatable doors 110 may be arranged side-by-side so as to extend from left side wall 202 to right side wall 204 in the closed position. In some embodiments, rotatable doors 110 may be arranged so as to extend across at least 75% of the distance from left side wall 202 to right side wall 204 in a closed portion. The at least 75% of the distance may be continuous or non-continuous (e.g., broken up by one or more pillars or beams located between rotatable doors 110).

In some embodiments, storefront 210 may be defined in part by one or more side doors 240. Side doors 240 may operate independently from rotatable doors 110. In some embodiments, side doors 240 may only be opened by pre-approved individuals (e.g., store managers) as a security feature. Side doors 240 may be hinged doors or slide doors (e.g., pocket doors). In some embodiments, side doors 240 may be transparent.

In operation, rotatable doors 110 may rotate from the closed position to the open position (FIG. 2) so as to allow individuals to enter store 200 by creating one or more walkways 140 for individuals to walk through (see e.g., FIG. 2). In some embodiments, each rotatable door 110 having an axis of rotation 130 located on the right side of the plurality of rotatable doors 110 in rotating door system 100 (i.e., on the right side of a horizontal center 212 of storefront 210 towards right side wall 204) may rotate in a first rotational direction and each rotatable door 110 having an axis of rotation 130 located on the left side of the plurality of rotatable doors 110 in rotating door system 100 (i.e., on the left side of a horizontal center 212 of storefront 210 towards left side wall 202) may rotate in a second rotational direction opposite the first rotational direction. As discussed herein, the right and left sides of the plurality of rotatable doors 110 are relative to a point of view 230 from outside store 200, through horizontal center 212 of storefront 210, to geometrical center 220. In other words, it is the point of view an individual would have if he or she were walking up to horizontal center 212 of storefront 210 from the outside of store 200.

In some embodiments, when rotating from between a closed position and open position, each rotatable door 110 having an axis of rotation 130 located on the right side of a geometrical center 220 of store may rotate in a first rotational direction (e.g., clockwise) and each rotatable door 110 having an axis of rotation 130 located on the left side of geometrical center 220 may rotate in a second rotational direction opposite the first rotational direction (e.g., counterclockwise). Clockwise and counterclockwise are used herein as viewed from a top-down perspective, as shown in FIG. 3. In some embodiments, each rotatable door 110 having an axis of rotation 130 located on the right side of geometrical center 220 may rotate clockwise and each door having an axis of rotation 130 located on the left side of geometrical center 220 may rotate counter-clockwise. As discussed herein, the right and left sides of geometrical center 220 are relative to point of view 230.

While FIGS. 1 and 2 show a one-level store 200 with a geometrical center 220 located in the middle of the entire store 200, geometrical center 220 may be defined by a portion of the store/building. For example, geometrical center 220 may be defined as the geometrical center of a lobby of building. As another example, geometrical center 220 may be defined as the geometrical center of a sales floor of a store.

FIG. 3 shows the rotational movement of a plurality of rotatable doors 110 when viewed from above according to an embodiment. As shown in FIG. 3, each rotatable door 110 located on the right side of horizontal center 212 (e.g., rotatable door 110*a*) may rotate in a clockwise direction 132 from the closed position (shown in broken lines) to the open position. Similarly, each rotatable door 110 located on the left side of horizontal center 212 (e.g., rotatable door 110*b*) may rotate in a counter-clockwise direction 134 from the closed position to the open position. In this manner, rotatable doors 110 may open inward (e.g., vertical edges 120 closer to horizontal center 212 move inward towards geometrical center 220 of store 200) so as to give the impression of inviting individuals into store 200.

Figure 4:
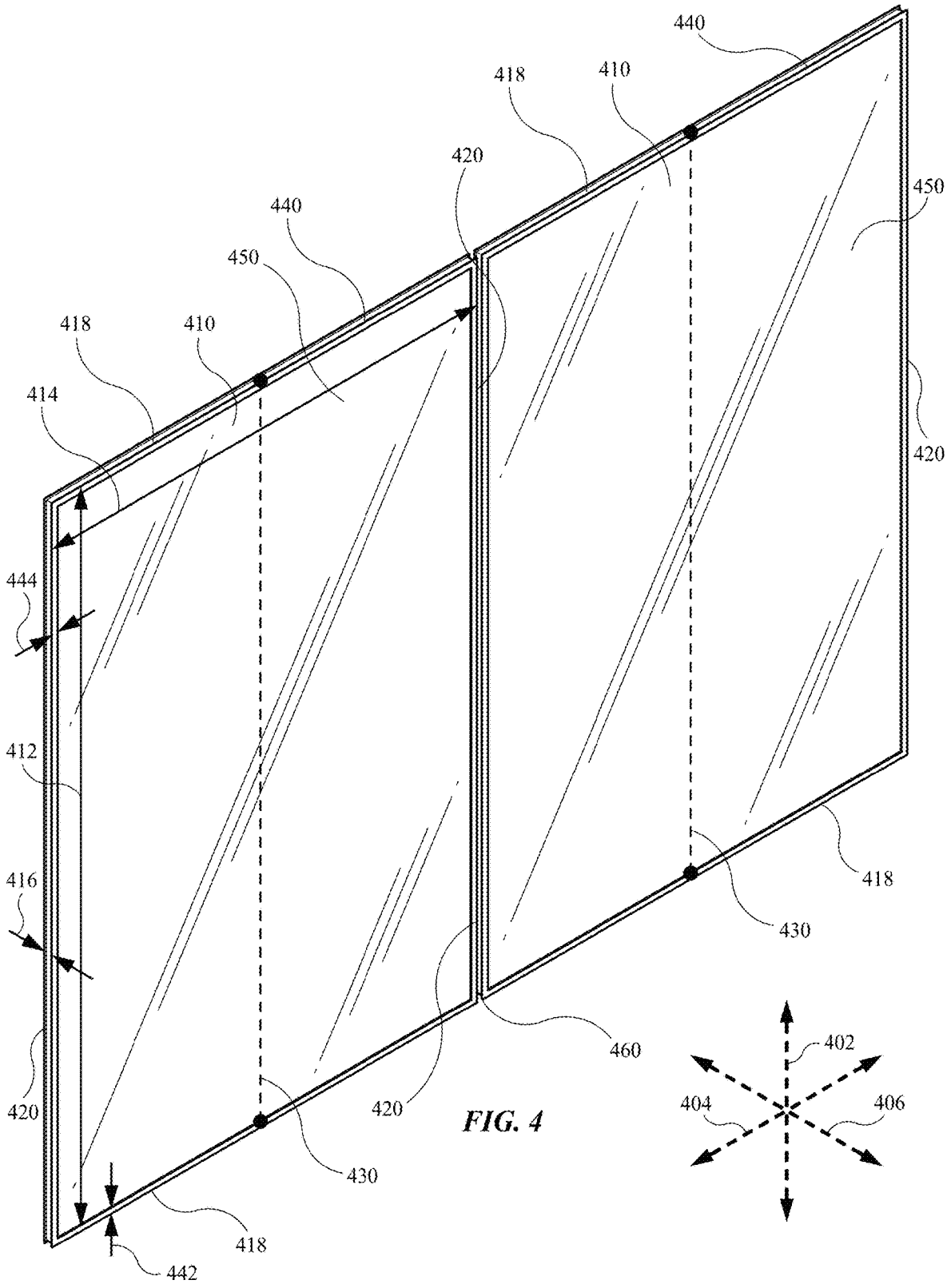
FIG. 4 shows a perspective view of a set of rotatable doors in a closed position according to an embodiment.
Figure 5:
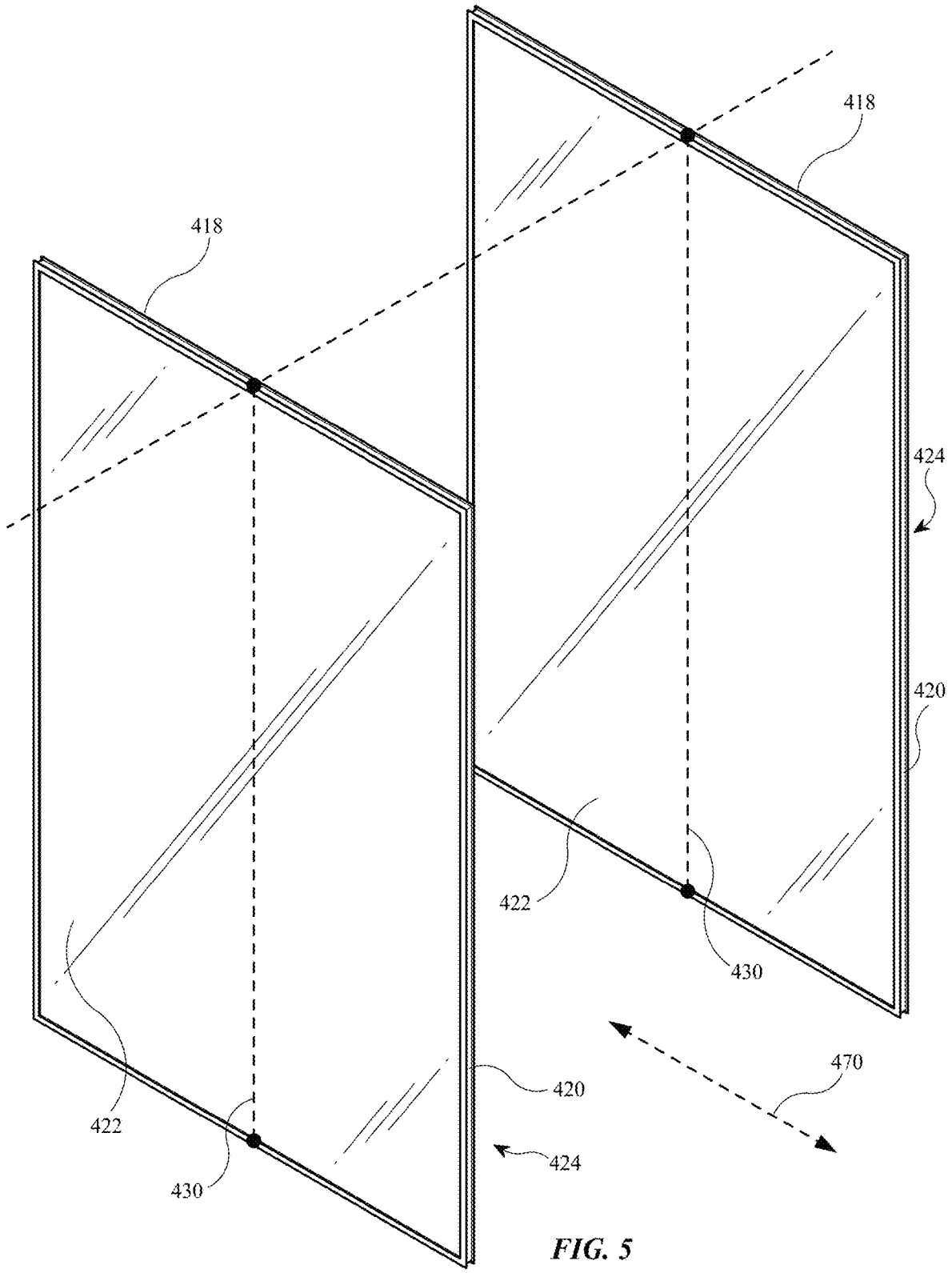
FIG. 5 shows a perspective view of a set of rotatable doors in an open position according to an embodiment.

FIGS. 4 and 5 show a set of rotatable doors 410 according to an embodiment in a closed position and an open position, respectively. In some embodiments, rotatable doors 410 may include a peripheral border 440 (e.g., a frame) disposed around at least a portion of a perimeter of a body 450. In some embodiments, peripheral border 440 may be disposed around the entirety of a perimeter of body 450. Peripheral border 440 may provide structural support for rotatable door 410 and may be coupled to an upper support and a lower support for rotatably supporting rotatable door 410 about axis of rotation 430. In some embodiments, peripheral border 440 may be formed of steel.

Characteristics of rotatable doors 110 described herein may also apply to rotatable doors 410 in some embodiments, and characteristics of rotatable doors 410 described herein may also apply to rotatable doors 110 in some embodiments. Similar to rotatable doors 110, each rotatable door 410 is defined by two opposing horizontal edges 418, two opposing vertical edges 420, a front surface 422, and a back surface 424. Also, each rotatable door 410 has a height 412 measured in a vertical direction 402 between opposing horizontal edges 418 and a width 414 measured in a horizontal direction 404 between opposing vertical edges 420. In some embodiments, rotatable door(s) 410 may have an axis of rotation 430 centrally located between opposing vertical edges 420. In this manner, rotatable door(s) 410 may rotate symmetrically about axis of rotation 430. Rotatable doors 410 may rotate in any of the fashions discussed above with regards to rotatable doors 110 to open and close a walkway 470. Additionally, rotatable doors 410 may have the same dimensions (e.g., height and width) and shapes as discussed above with regards to rotatable doors 110. For example, in some embodiments, rotatable doors 410 may have a height 412 of at least 10 feet and a width 414 of at least 8 feet. In some embodiments, rotatable doors 410 may have a height 412 of approximately 12 feet and a width 414 of approximately 10 feet.

As shown in FIGS. 4 and 5, peripheral border 440 may define at least a portion of horizontal edges 418, vertical edges 420, and a boarder around the periphery of front surface 422 and back surface 424. In some embodiments, peripheral border 440 may define the entirety of horizontal edges 418 and vertical edges 420. In some embodiments, portions of peripheral border 440 defining horizontal edges 418 may have a height 442 in the range of 1 inch to 2 inches (25.4 mm to 50.8 mm). In some embodiments, height 442 may be approximately 1.5 inches (approximately 40 mm). In some embodiments, portions of peripheral border 440 defining vertical edges 420 may have a width 444 in the range of 1 inch to 2 inches (25.4 mm to 50.8 mm). In some embodiments, width 444 may be approximately 1.5 inches (approximately 40 mm).

Also, peripheral border 440 may define a peripheral thickness 416 of a rotatable door 410 in a horizontal direction 406 perpendicular to horizontal direction 404. In some embodiments, peripheral thickness 416 may be in the range of 1 inch to 2 inches (25.4 mm to 50.8 mm). In some embodiments, peripheral thickness 416 may be approximately 1.5 inches (approximately 40 mm). In some embodiments, vertical edges 420 defined by peripheral border 440 may be spaced apart in the closed position (see space 460 in FIG. 4). In some embodiments space 460 may be between ¼ of an inch and one inch. In some embodiments, space 460 may be approximately ½ of an inch.

Body 450 may include a transparent portion defining at least a portion of front surface 422 and back surface 424. In this manner, one or more rotatable doors 410 may be see-through. In some embodiments, body 450 may include a transparent panel (e.g., a transparent panel 452) defining at least a portion of front surface 422 and back surface 424. In some embodiments, body 450 may include a plurality of glass panels 452 defining at least a portion of front surface 422 and/or back surface 424. In some embodiments, body 450 may include a plurality of stacked transparent panels 452, with one panel 452 defining at least a portion of front surface 422 and one panel 452 defining at least a portion of back surface 424 (see e.g., panels 452 in FIG. 8). In some embodiments, body 450 may include a panel 452 defining a majority of front surface 422 and/or back surface 424 of rotatable door 410. In some embodiments, body 450 may include a transparent panel 452 (or stack of transparent panels 452) defining at least 90% of the surface area of front surface 422 and back surface 424 of rotatable door 110. In some embodiments, body 450 may include a transparent panel 452 (or stack of transparent panels 452) defining at least 95% of the surface area of front surface 422 and back surface of rotatable door 410. In some embodiments, body 450 and peripheral border 440 may define the entire front surface 422 and back surface 424 of a rotatable door 410 (i.e., define the entire height 412 and width 414 of a rotatable door 410).

Transparent materials for panels 452 include but are not limited to glass, glass ceramics, polymers (e.g., polycarbonate and Poly(methyl methacrylate)) and combinations thereof. In some embodiments, panels 452 may be laminated together. In some embodiments, panels 452 may be a tempered or shatterproof glass. In some embodiments, body 450 may include color-changing or transparency-changing material (e.g. electrochromic glass or polymer dispersed liquid crystals).

Figure 6:
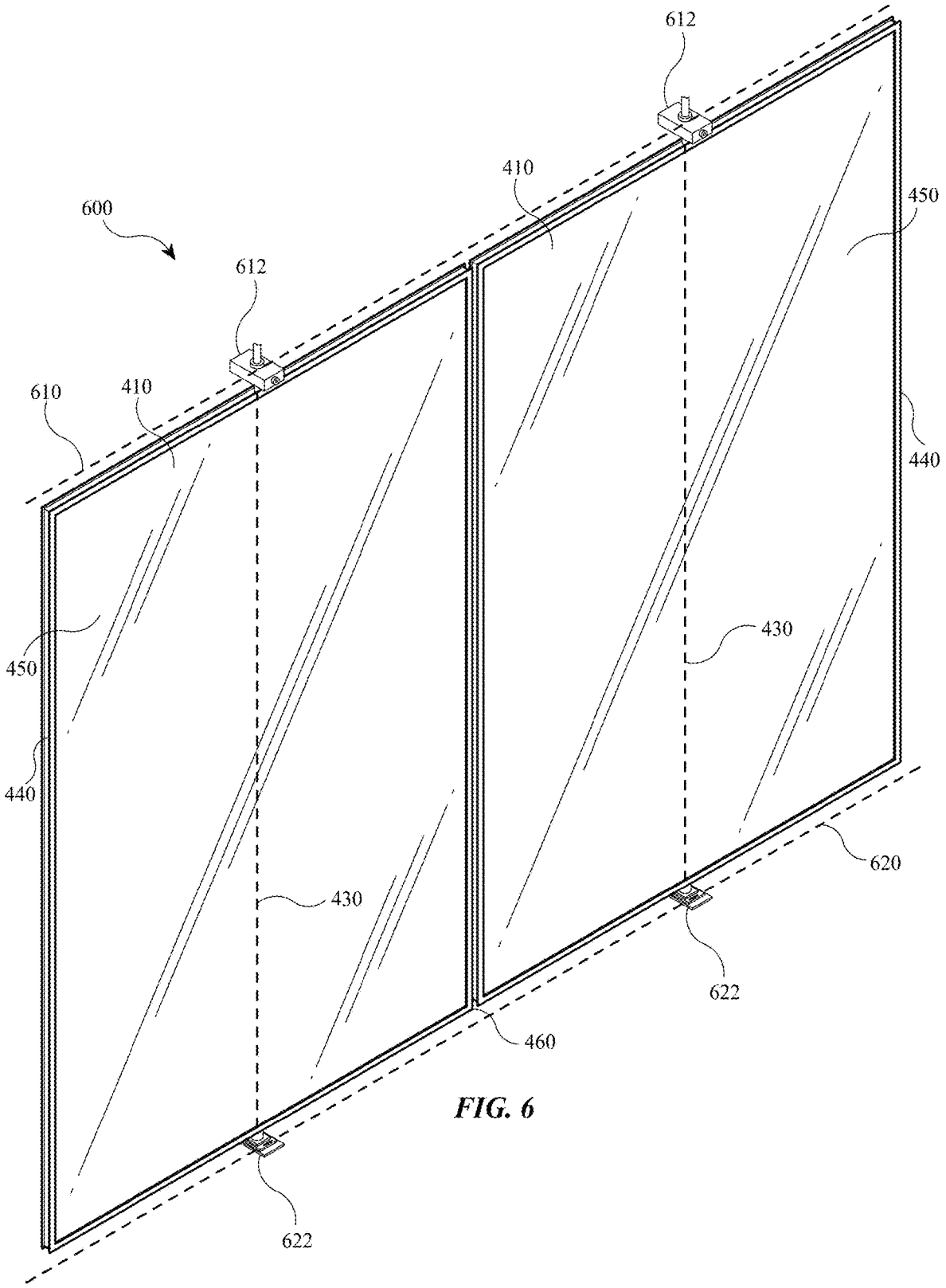
FIG. 6 shows a perspective view of a rotating door system in a closed position according to an embodiment.

FIG. 6 shows a rotating door system 600 including rotatable doors 410 rotatably coupled to an upper support 610 and a lower support 620 about respective axes of rotation 430 according to an embodiment. In some embodiments, upper support 610 may include a ceiling (e.g., ceiling 206). In some embodiments, upper support 610 may include an upper support beam (e.g., support beam 1010). In some embodiments, lower support 620 may include a floor (e.g., floor 208). In some embodiments, lower support 620 may include a lower support beam (e.g., support beam 1010). A rotatable door 410 may be rotatably coupled to upper support 610 and lower support 620 via an upper support assembly 612 and a lower support assembly 622, respectively. Exemplary upper support assemblies 612 and lower support assemblies 622 are discussed herein with respect to FIGS. 8-12.

Figure 7:
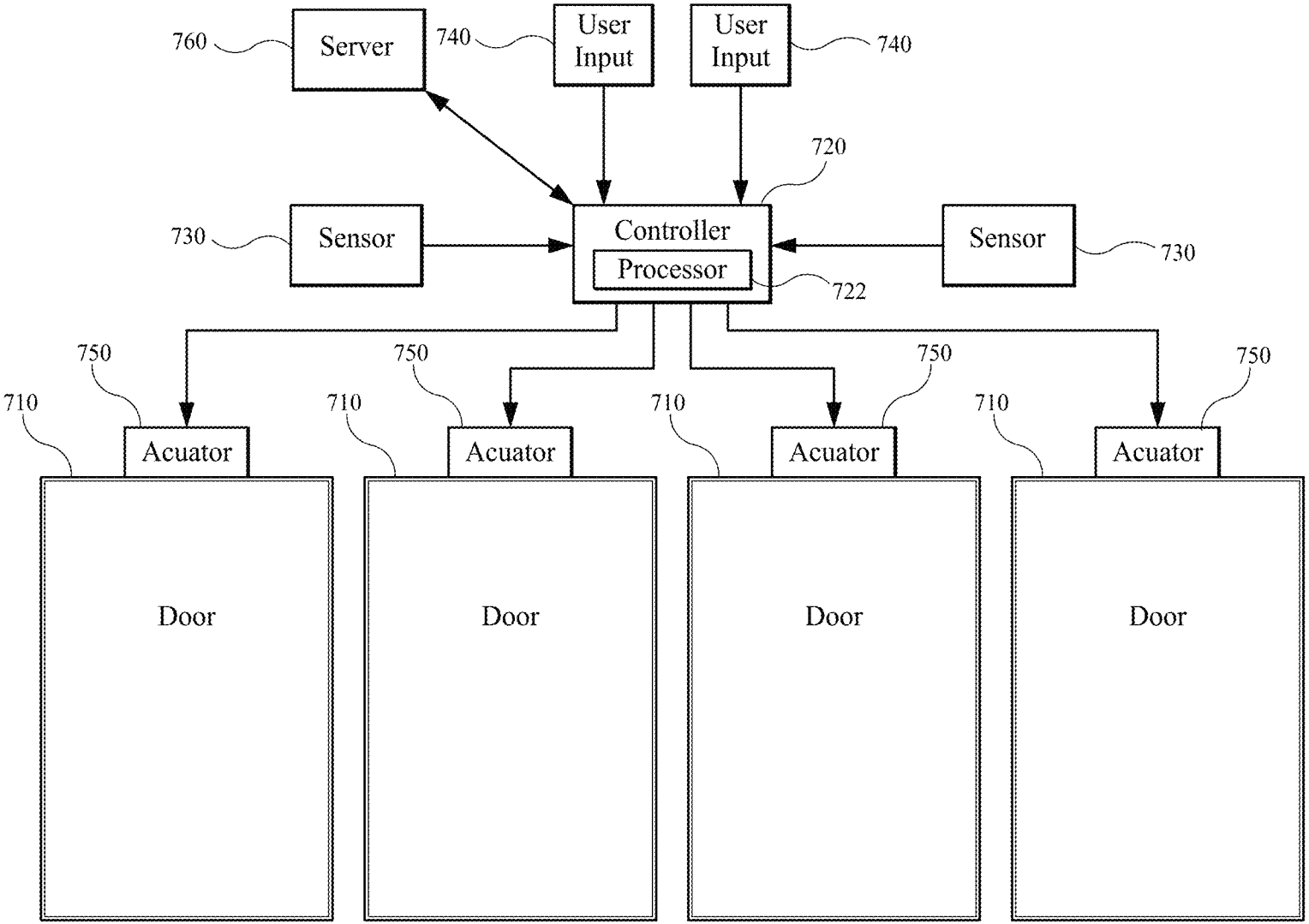
FIG. 7 shows a control system for rotating one or more rotatable doors according to an embodiment.

In some embodiments, one or more rotatable doors may be rotated under control of a controller, automatically and/or in response to a signal (e.g., a user input). FIG. 7 shows a control system 700 for controlling the rotation of one or more rotatable doors 710 according to an embodiment. As shown in FIG. 7, control system 700 may include a controller 720 in communication with a plurality of rotatable doors 710. Rotatable doors 710 may be, e.g., any rotatable door discussed herein (e.g., doors 110 and 410). Controller 720 may be configured to rotate each rotatable door 710, together or individually, in any manner discussed herein with respect to rotatable doors 110 or 410. In some embodiments, controller 720 may be configured to rotate each rotatable door 710 simultaneously or sequentially. In some embodiments, controller 720 may be in communication with actuators 750 associated with individual rotatable doors 710. In some embodiments, each actuator 750 may include a motor (e.g., electric motor).

In some embodiments, control system 700 may include one or more sensors 730 in communication with controller 720. In some embodiments, controller 720 may be configured to control the rotation of one or more rotatable doors 710 based on signals received from one or more sensors 730. In some embodiments, controller 720 may be configured to prevent or stop rotation of one or more rotatable doors 710 in response to receiving a signal from one or more sensors 730. For example, if a sensor 730 detects the presence of an object between two rotatable doors in the open position, sensor 730 may send a signal to controller 720 indicating the presence of the object and, in turn, controller 720 may prevent or stop rotation of the two rotatable doors 710. Sensors 730 may include, but are not limited to, a motion sensor, an IR (infrared) sensor, a heat sensor, a touch sensor, a camera, a microphone, or a combination thereof.

In some embodiments, control system 700 may include one or more user inputs 740 in communication with controller 720. User inputs 740 may be configured to receive a user command to rotate rotatable doors 710 from the closed position to the open position, or vice versa, and to send a signal to controller 720. User inputs 740 may include, but are not limited to, a button, a keyboard, a touch screen, a remote control, or a mobile phone.

In some embodiments, controller 720 may be in communication with a server 760. In such embodiments, controller 720 may be in communication with and receive commands from server 760. For example, server 760 may send a command to controller 720 to rotate one or more rotatable doors 710 from the closed position to the open position, or vice versa. In some embodiments, server 760 may be a local (e.g., on site) server. In some embodiments, server 760 may be a remote server. In some embodiments, server 760 may be in communication with sensor(s) 730 and/or user inputs 740, either directly or via controller 720. In some embodiments, server 760 may be in communication with a central controller. In such embodiments, controllers 720 at different locations (e.g., different stores 200) may receive commands from the central controller via server 760. For example, a central controller may be configured to send a command to simultaneously open one or more rotatable doors 710 at different locations via server 760.

Control system 700, or components thereof, may be incorporated into a building, store, etc. having one or more rotatable doors 710. As an example, store 200 may include a control system 700. In such embodiments, sensor(s) 730 may be located on ceiling 206, on left side wall 202, on right side wall 204, on floor 208, and/or on rotatable doors 110, 410, 710 themselves. In some embodiments, a processor 722 of controller 720 may receive a signal (e.g., from user input 740 or server 760) to open a doorway (e.g., storefront 210), and, in response to receiving the signal, controller 720 may control at least one motor to simultaneously rotate a plurality of rotatable doors defining at least a portion of the doorway about their respective axes of rotation.

Figure 8:
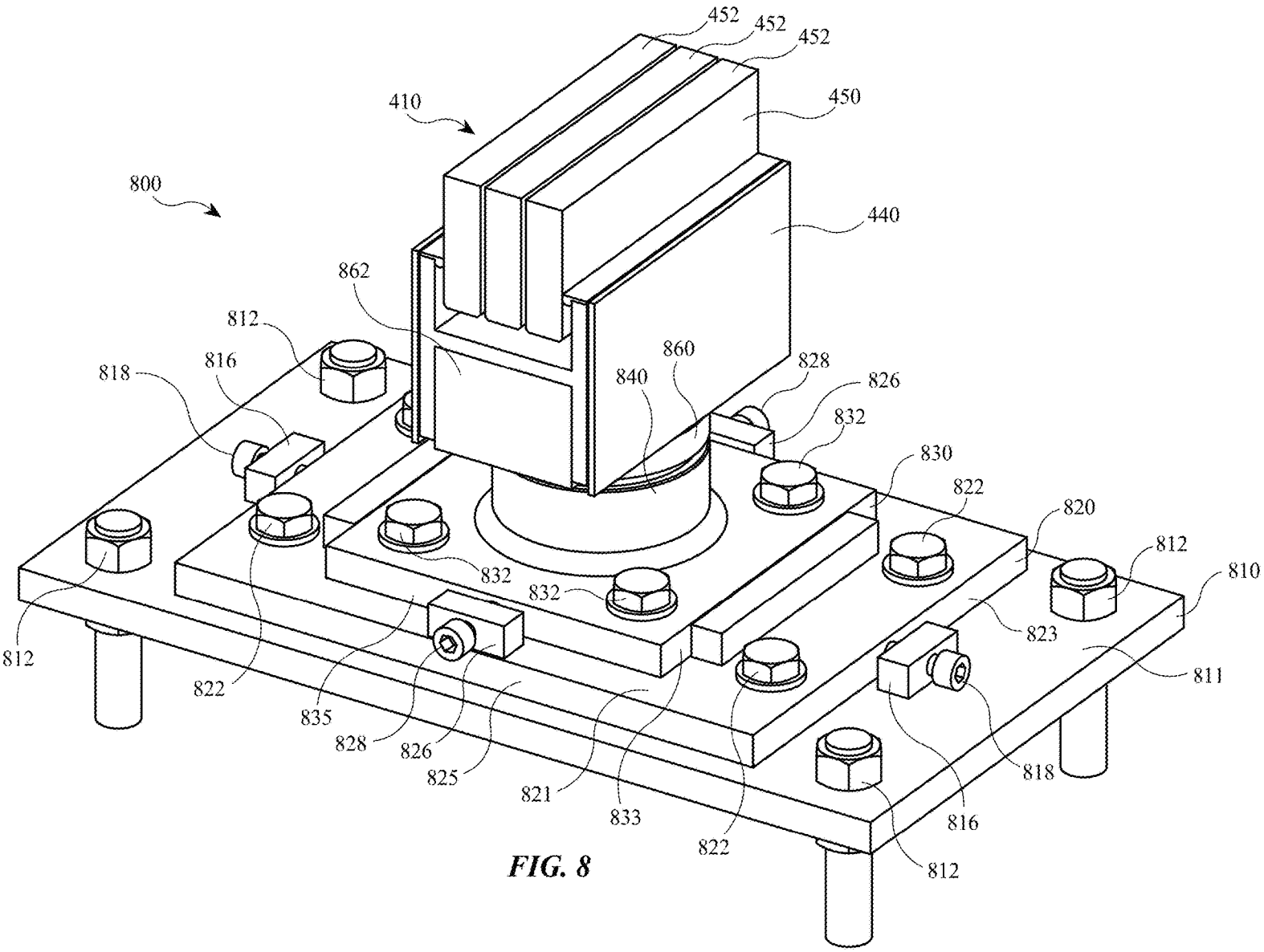
FIG. 8 shows an assembled view of a lower support assembly according to an embodiment.
Figure 9:
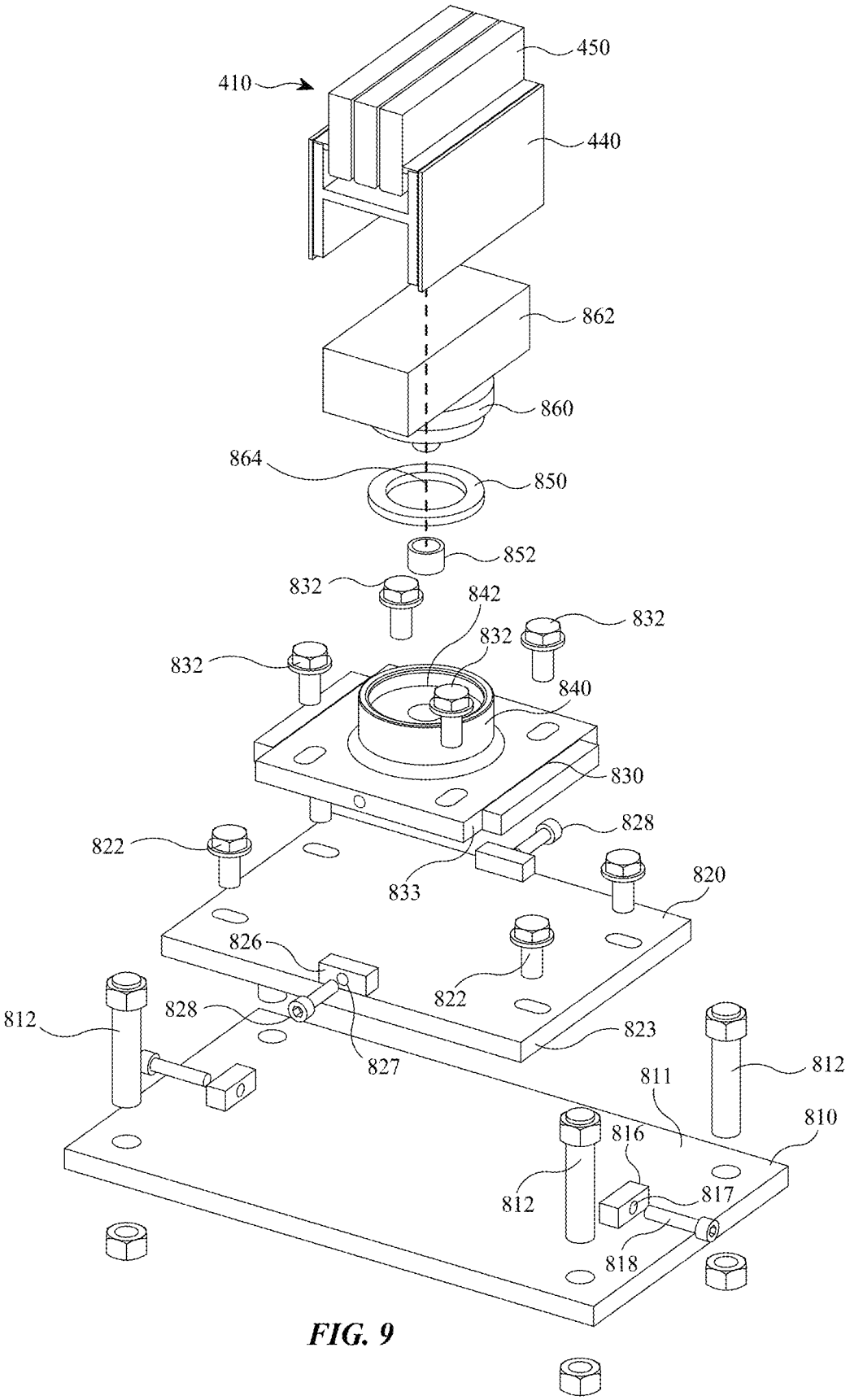
FIG. 9 shows an exploded view of a lower support assembly according to an embodiment.

FIGS. 8 and 9 show a lower support assembly 800 for rotatably supporting a rotatable door according to an embodiment. Lower support assembly 800 may include a lower support plate 810, a gimbal plate 820, and a bearing plate 830. Lower support plate 810 may include a plurality of fasteners 812 configured to secure lower support plate 810 to a lower support (e.g., a support beam the same as or similar to support beam 1010) and/or a floor (e.g., floor 208)). In some embodiments, lower support assembly 800 may be at least partially disposed in an opening of a support beam and/or in a recess formed in floor 208. Similar to lower support plate 810, gimbal plate 820 may include a plurality of fasteners 822 configured to secure gimbal plate 820 to lower support plate 810. Fasteners 812/822 may be, but are not limited to, screws, rivets, or bolts. In some embodiments, lower support plate 810 and/or gimbal plate 820 may alternatively or additionally be adhered (e.g., by welding) to a lower support (e.g., beam or floor) and lower support plate 810, respectively.

Lower support plate 810 and gimbal plate 820 may be configured to provide horizontal motion with two degrees of freedom in the horizontal plane for bearing plate 830 before being fully secured into place (e.g., before fasteners 812/822 are fully assembled and tightened). In this manner, lower support plate 810 and gimbal plate 820 may serve to vertically align a center axis 864 of a lower pivot shaft 860 with a center axis 1024 of an upper pivot shaft 1020 before a rotatable door is installed on lower support assembly 800.

In some embodiments, lower support plate 810 may include one or more alignment blocks 816 configured to align the center axes 864/1024 of lower pivot shaft 860 and upper pivot shaft 1020 (e.g., in a first horizontal direction 404). Alignment block(s) 816 may be fixed to a top surface 811 of lower support plate 810 via, for example, welding. In some embodiments, alignment block(s) 816 may be integrally formed with top surface 811 of lower support plate 810 (e.g., via molding and/or machining). Alignment block(s) 816 may include an alignment aperture 817 configured to receive an alignment screw 818, where rotation of alignment screw 818 causes linear motion of gimbal plate 820 relative to lower support plate 810 in first horizontal direction 404. In some embodiments, alignment blocks 816 may be positioned adjacent to one or more transverse sides 823 of gimbal plate 820 when lower support plate 810 and gimbal plate 820 are assembled.

Similar to lower support plate 810, gimbal plate 820 may include one or more alignment blocks 826 configured to align the center axes of lower pivot shaft 860 and upper pivot shaft 1020 (e.g., in a second horizontal direction different from the first (e.g., in second horizontal direction 406 perpendicular to first horizontal direction 404)). Alignment block(s) 826 may be fixed to a top surface 821 of gimbal plate 820 via, for example, welding. In some embodiments, alignment block(s) 826 may be integrally formed with top surface 821 of gimbal plate 820 (e.g., via molding and/or machining). Alignment block(s) 826 may include an alignment aperture 827 configured to receive an alignment screw 828, where rotation of alignment screws 828 causes linear motion of bearing plate 830 relative to gimbal plate 820 in second horizontal direction 406. In some embodiments, alignment blocks 826 may be positioned adjacent to one or more longitudinal sides 835 of bearing plate 830 when gimbal plate 820 and bearing plate 830 are assembled.

In some embodiments, at least one alignment block 816/826 may be configured to allow bearing plate 830 to be moved (aligned) in a first horizontal direction (e.g., horizontal direction 404) and at least one alignment block 816/826 may be configured to allow bearing plate 830 to be moved (aligned) in a second horizontal direction different from the first horizontal direction (e.g., second horizontal direction 406 perpendicular to first horizontal direction 404). As an example, FIGS. 8 and 9 show lower support plate 810 including two alignment blocks 816 configured to align bearing plate 830 in first horizontal direction 404 and gimbal plate 820 including two alignment blocks 826 configured to align bearing plate 830 in a second horizontal direction 406.

Small movements of bearing plate 830 in either first horizontal direction 404 or second horizontal direction 406 may be accomplished by slightly screwing or unscrewing an alignment screw 818/828. In operation, alignment screws 818 may be threaded through respective alignment apertures 817 so as to engage transverse sides 823 of gimbal plate 820, thereby moving gimbal plate 820 in first horizontal direction 404. This will in turn move bearing plate 830 in first horizontal direction 404. Similarly, alignment screws 828 may be threaded through respective alignment apertures 827 so as to engage longitudinal sides 835 of bearing plate 830, thereby moving bearing plate 830 in second horizontal direction 406. In this manner, the threading of alignment screws 818/828 may allow for precise positioning of bearing plate 830. Once bearing plate 830 is properly aligned, bearing plate 830 may be secured to gimbal plate 820 via fasteners 832 and gimbal plate 820 may be secured to lower support plate 810 via fasteners 822.

While FIGS. 8 and 9 show alignment blocks 816/826 located on lower support plate 810 and gimbal plate 820, respectively. In some embodiments, all the alignment blocks 816/826 may be located on lower support plate 810 or gimbal plate 820. Also, while FIGS. 8 and 9 show alignments blocks 816 positioned adjacent to transverse sides 823 of gimbal plate 820, alignment blocks 816 may be alternatively or additionally be positioned adjacent to the longitudinal sides 825 of gimbal plate 820. Similarly, alignment blocks 826 may be alternatively or additionally be positioned adjacent to the transverse sides 833 of bearing plate 830. In other words, gimbal plate 820 may allow for positioning of bearing plate 830 in first horizontal direction 404 and lower support plate 810 may allow for positioning of bearing plate 830 in second horizontal direction 406.

As shown in FIGS. 8 and 9, bearing plate 830 coupled to lower pivot shaft 860. In some embodiments, bearing plate 830 may include a pivot shaft support 840 for rotatably supporting a lower pivot shaft 860. Pivot shaft support 840 may include an open end 842 configured to receive a portion of lower pivot shaft 860 and allow lower pivot shaft 860 to freely rotate therein. In some embodiments, pivot shaft support 840 may include one or more bearings (e.g., bearings 850 and 852) configured to rotatably support lower pivot shaft 860 in pivot shaft support 840 and allow lower pivot shaft 860 to freely rotate.

A rotatable door (e.g., rotatable door 110, 410 or 710) may be rotatably coupled to a lower support (e.g., floor or support beam) via lower pivot shaft 860 at an axis of rotation (e.g., axis 130 or 430) of the rotatable door. In some embodiments, lower pivot shaft 860 may include a coupling 862 for attaching lower pivot shaft 860 and the rotatable door. In some embodiments, as shown in FIGS. 8 and 9, lower pivot shaft 860 may include a coupling 862 configured to attach to a peripheral border (e.g., 440) of a rotatable door (e.g., 410). In some embodiments, lower pivot shaft 860 and/or coupling 862 may not extend through peripheral border 440 into body 450 of rotatable door 410. In such embodiments, no portion of lower pivot shaft 860 is visible in body 450 of rotatable door 410.

Figure 10:
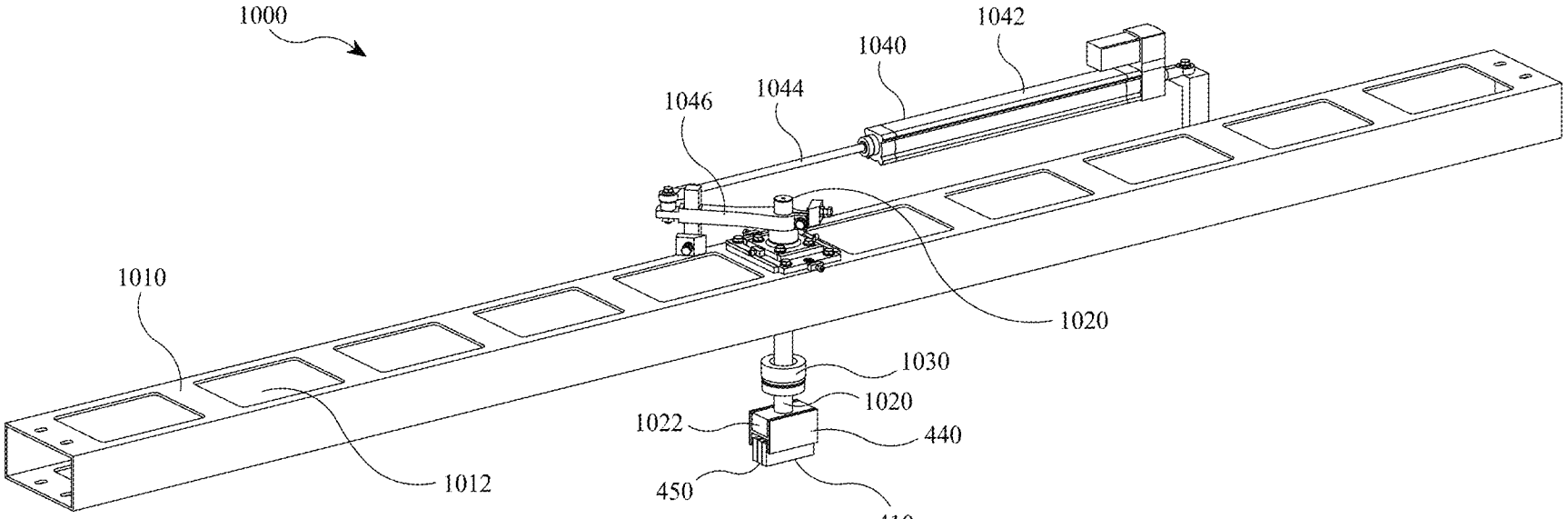
FIG. 10 shows an assembled view of an upper support assembly according to an embodiment.
Figure 11:
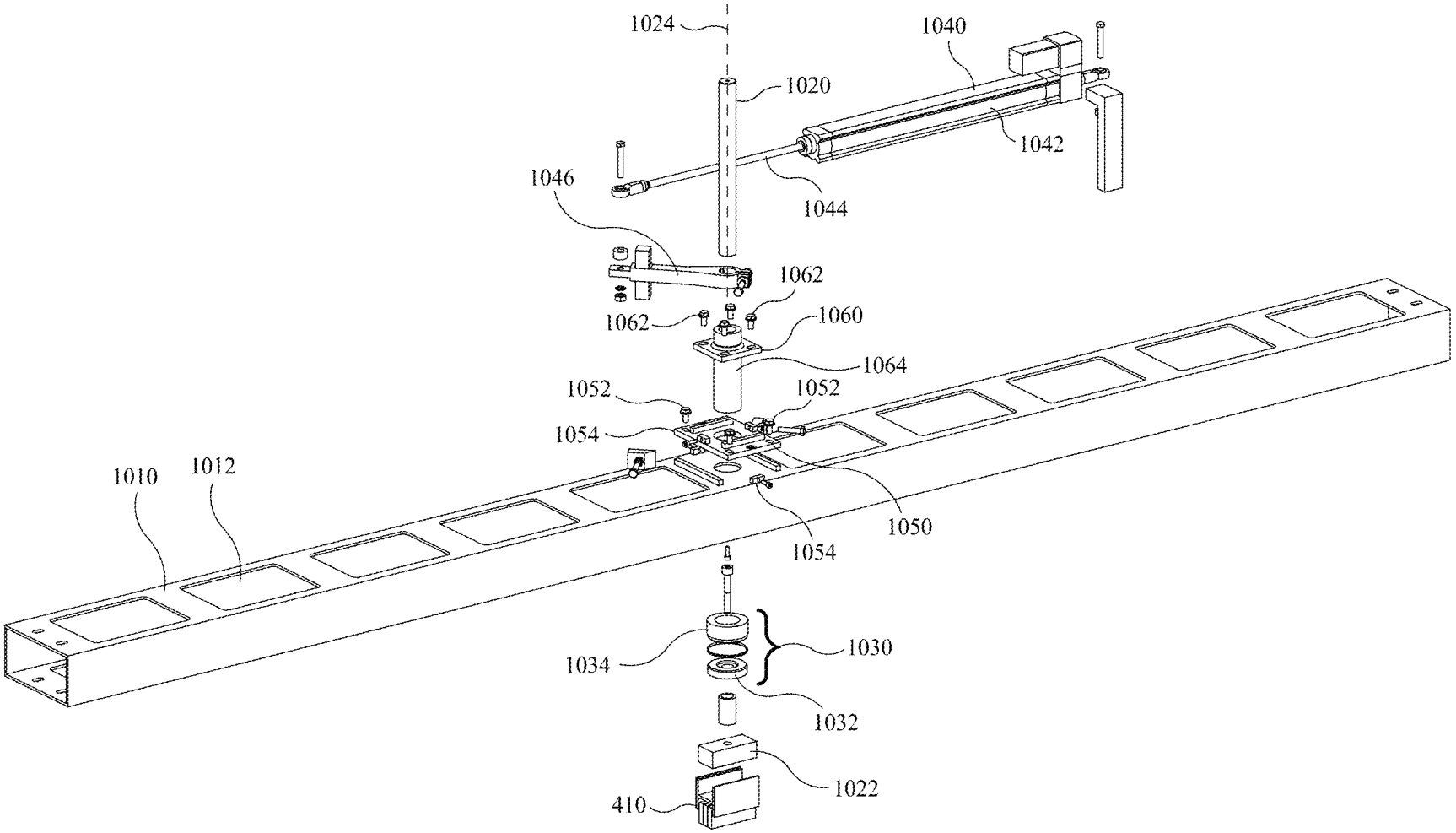
FIG. 11 shows an exploded view of an upper support assembly according to an embodiment.
Figure 12:
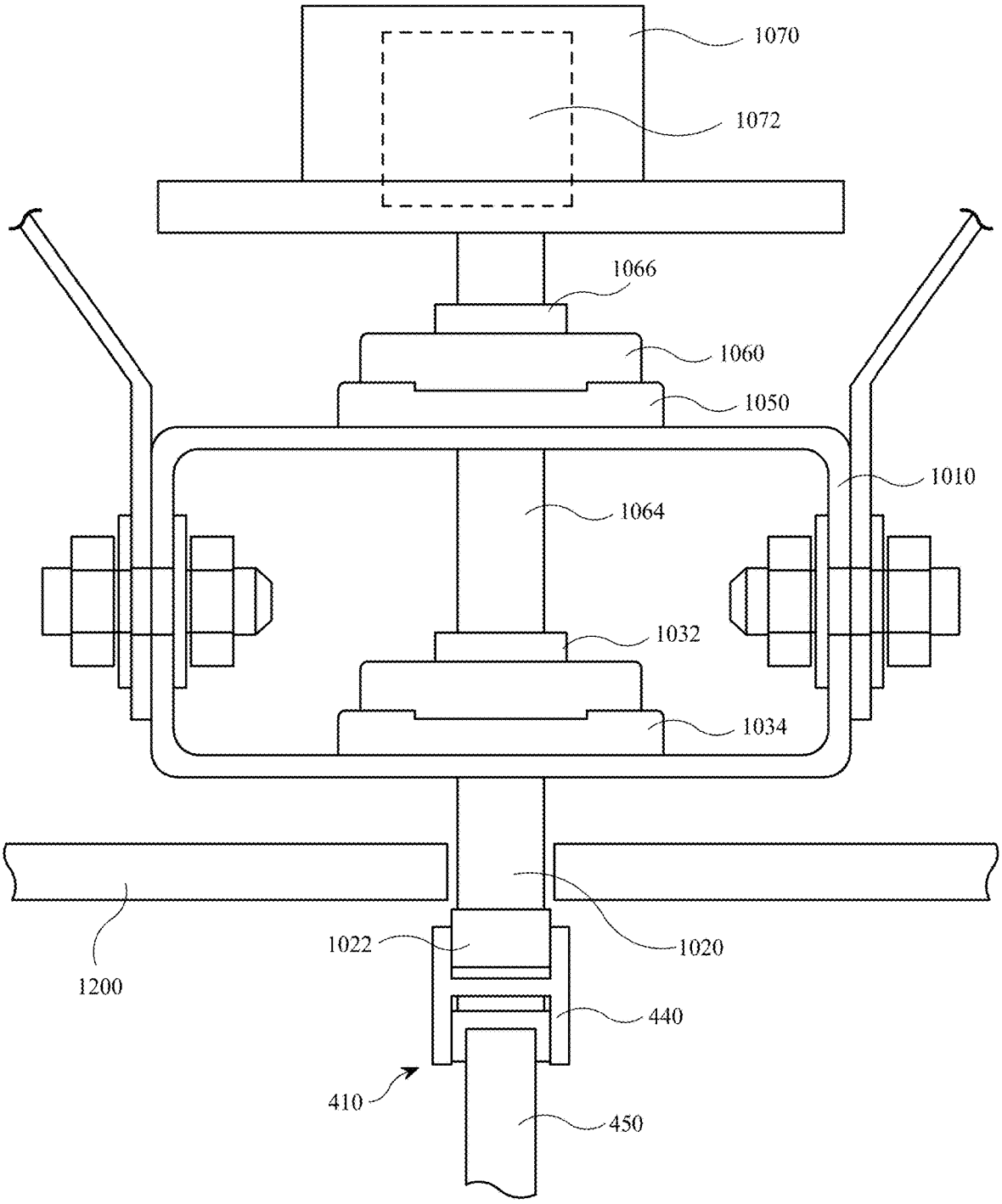
FIG. 12 shows a cross-sectional view of an upper support assembly according to an embodiment.

FIGS. 10-12 show an upper support assembly 1000 for rotatably supporting a rotatable door according to an embodiment. Upper support assembly 1000 may include a support beam 1010. In some embodiments, support beam 1010 may include a plurality of openings 1012 for receiving components of upper support assembly 1000 to conceal the components from view. In other words, upper support assembly 1000 may be at least partially disposed in an opening 1012 of support beam 1010. A rotatable door (e.g., rotatable door 110, 410, or 710) may be rotatably coupled to an upper support (e.g., ceiling 206 and/or support beam 1010) via an upper pivot shaft 1020 at an axis of rotation (e.g., axis 130 or 430) of the rotatable door. Upper pivot shaft 1020 may be rotatably coupled to a ceiling and/or support beam 1010 via one or more of a bearing assembly 1030, an alignment plate 1050, and a support plate 1060.

In some embodiments, upper pivot shaft 1020 may include a coupling 1022 for attaching upper pivot shaft 1020 and a rotatable door. In some embodiments, as shown in FIGS. 10-12, upper pivot shaft 1020 may include a coupling 1022 configured to attach to a peripheral border (e.g., 440) of a rotatable door (e.g., 410). In some embodiments, upper pivot shaft 1020 and/or coupling 1022 may not extend through peripheral border 440 into body 450 of rotatable door 410. In such embodiments, no portion of upper pivot shaft 1020 is visible in body 450 of rotatable door 410.

Bearing assembly 1030 may include one or more bearings 1032 and a bearing support plate 1034 rotatably coupling upper pivot shaft 1020 to support beam 1010. Alignment plate 1050 may be configured to align center axis 1024 of upper pivot shaft 1020 and with center axis 864 of lower pivot shaft 860 and may be secured to support beam 1010 via a plurality of fasteners 1052. In some embodiments, alignment plate 1050 may include one or more alignment blocks 1054 configured to align support plate 1060 in horizontal direction 404 and/or horizontal direction 406. Alignment blocks 1054 may be the same as or similar to alignment blocks 816/826. Fasteners 1052 may include, but are not limited to, screws, rivets, bolts. In some embodiments, alignment plate 1050 may alternatively or additionally be welded to support beam 1010.

Support plate 1060 may include hollow casing 1064 for rotatably receiving a portion of upper pivot shaft 1020. In some embodiments, support plate 1060 may include a bearing assembly 1066 for rotatably supporting upper pivot shaft 1020 and/or casing 1064. Support plate 1060 may be coupled to alignment plate 1050 via fasteners 1062. Fasteners 1062 may include, but are not limited to, to, screws, rivets, bolts. In some embodiments, support plate 1060 may alternatively or additionally be welded to alignment plate 1050.

In some embodiments, upper support assembly 1000 may include a brake 1040. Brake 1040 may be a hydraulic brake including a hydraulic tube 1042 configured to receive a hydraulic shaft 1044. Hydraulic shaft 1044 may be coupled to a brake arm 1046 that is attached to upper pivot shaft 1020. Brake 1040 may be configured to prevent undesirable rotation of a rotatable door. For example, brake 1040 may prevent a rotatable door from rotating more than 90 degrees when rotating from a closed position to an open position. In some embodiments, brake 1040 may facilitate smooth rotational movements of a rotatable door. In such embodiments, brake 1040 may work in conjunction with an actuator 1070 to ensure that a rotatable door smoothly rotates from an open (or closed) position to a closed (or open) position at desired speed(s).

As shown in FIG. 12, an actuator 1070 may be coupled to upper pivot shaft 1020. Actuator 1070 may include a gear assembly 1072 coupled to and configured to rotate upper pivot shaft 1020. In operation, actuator 1070 may be coupled to and configured to rotate gear assembly 1072 to thereby rotate upper pivot shaft 1020. In some embodiments, gear assembly 1072 may include a spindle. In some embodiments, actuator 1070 may be an electric motor. In some embodiments, actuator 1070 may be a variable speed motor. In some embodiments, actuator 1070 may be a mechanical actuator such as a pulley or gear. In such embodiments, a motor driving to a belt or chain may be configured to rotate one or more pulleys or gears so as to rotate one or more rotatable doors.

While certain components of lower support assembly 800 and upper support assembly 1000 have been described in reference to being in lower support assembly 800 and upper support assembly 1000, these components may be alternatively or additionally incorporated into either support assembly. For example, upper support assembly 1000 may include a support plate and gimbal plate the same as or similar to lower support plate 810 and gimbal plate 820 for aligning center axes 864/1024 of lower pivot shaft 860 and upper pivot shaft 1020. As another example, upper support assembly 1000 may include an actuator and/or brake the same as or similar to actuator 1070 and brake 1040.

Figure 13:
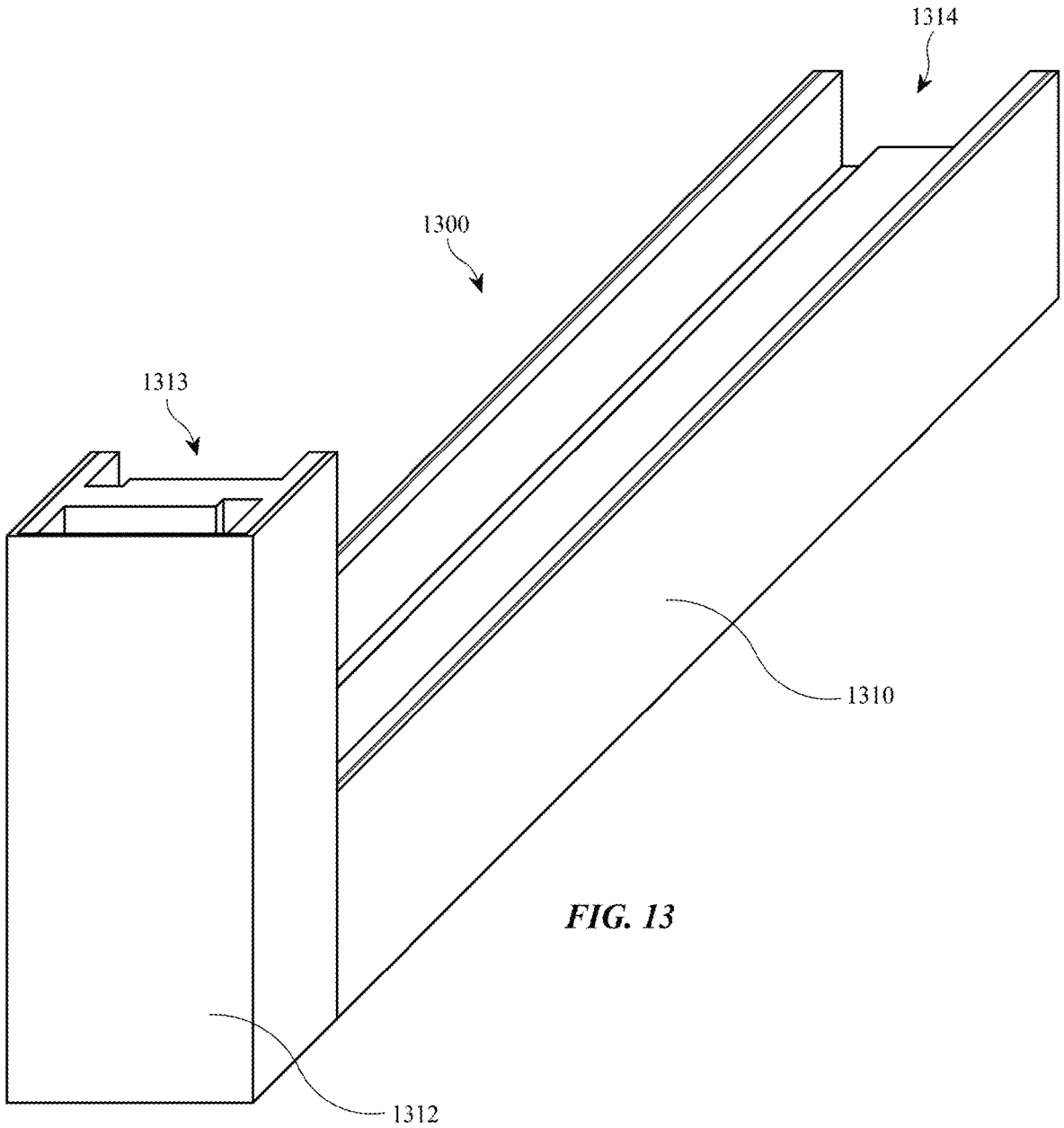
FIG. 13 shows a perspective view of a portion of a peripheral border for a rotatable door according to an embodiment.
Figure 14:
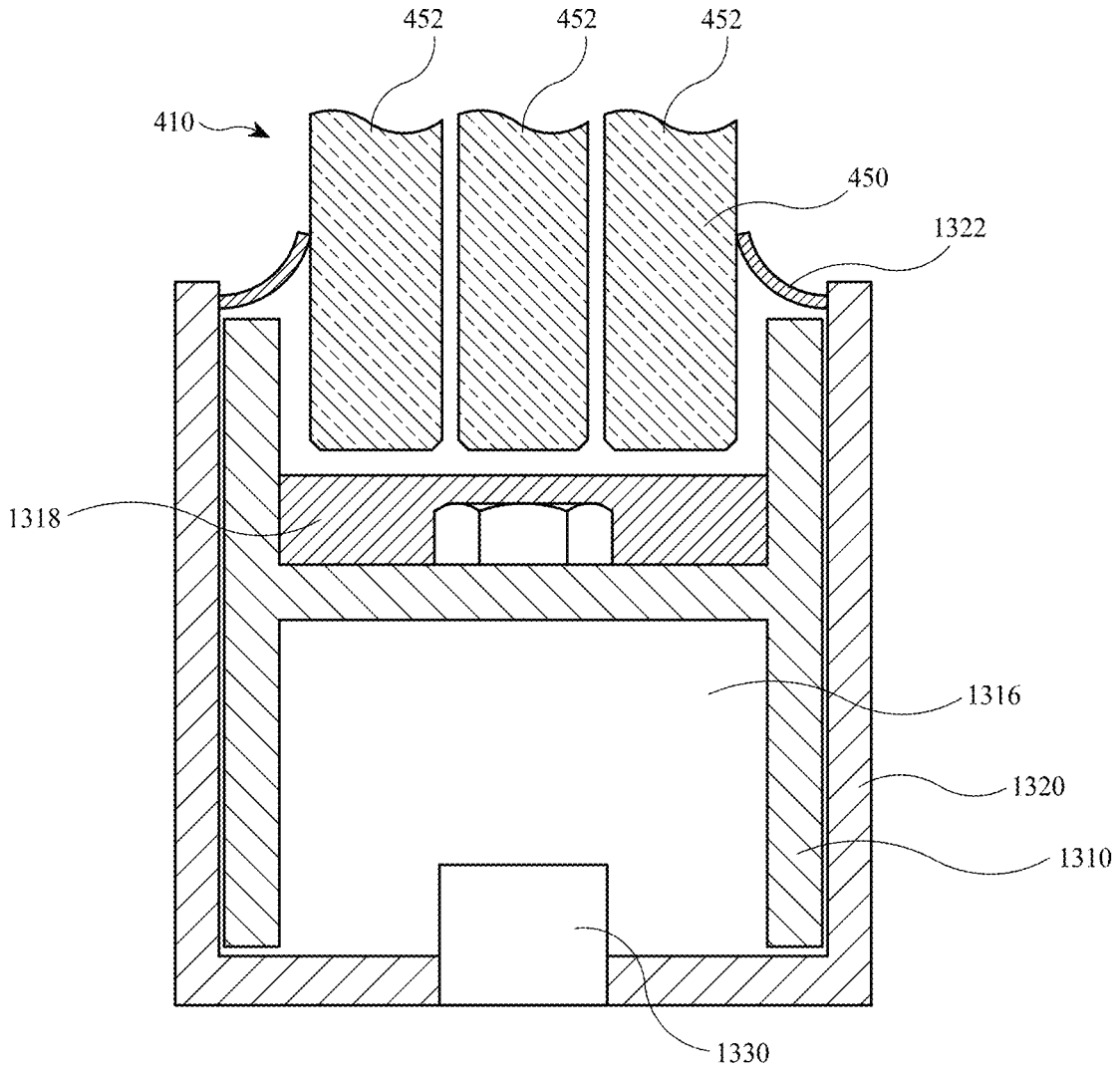
FIG. 14 shows a cross-sectional view of a peripheral border of a rotatable door according to an embodiment.

FIGS. 13 and 14 show a peripheral border 1300 according to an embodiment. In some embodiments, peripheral border 1300 may include a horizontal crossbar 1310 having a groove 1314 sized and shaped (dimensioned) to revive a horizontal edge of a rotatable door body (e.g., body 450). In some embodiments, peripheral border 1300 may include a vertical crossbar 1312 having a groove 1313 sized and shaped to receive a vertical edge of a rotatable door body (e.g., body 450). In some embodiments, a cushioning element 1318 may be disposed in grooves 1314/1313 for protecting the horizontal edges and/or vertical edges of a rotatable door body. In some embodiments cushioning element 1318 may include structural silicone. In some embodiments, horizontal crossbar 1310 and/or vertical crossbar 1312 may include a seal/weatherproofing 1322 for sealing peripheral border 1300 to a body of a rotatable door.

In some embodiments, peripheral border 1300 may include a cavity 1316 located around all or a portion of a perimeter of horizontal crossbars 1310 and vertical crossbars 1312. Cavity 1316 may be at least partially enclosed by cladding 1320 disposed around all or a portion of a perimeter of horizontal crossbars 1310 and vertical crossbars 1312. In some embodiments, cladding 1320 may be bronze cladding. In some embodiments, a portion of cavity 1316 located on horizontal crossbars 1310 may be sized and shaped to receive couplings 862 and 1022 of lower pivot shaft 860 and upper pivot shaft 1020, respectively.

In some embodiments, one or more a locking mechanisms 1330 may be disposed in a portion of cavity 1316. Locking mechanism(s) 1330 may extend from and retract into cavity 1316 so as to lock and unlock a rotatable door in a closed and/or open position. In some embodiments, locking mechanism(s) 1330 may include a magnetic locking mechanism to lock and unlock a rotatable door in a closed and/or open position. In some embodiments, locking mechanism(s) 1330 may be manually controlled (e.g., with a key). In some embodiments, locking mechanism(s) 1330 may be controlled by a controller (e.g., controller 720).

One or more aspects of the rotatable door systems and methods discussed herein or function(s) thereof may be implemented using hardware, software modules, firmware, tangible computer readable media having instructions stored thereon, or a combination thereof and may be implemented in one or more computer systems or other processing systems.

Figure 15:
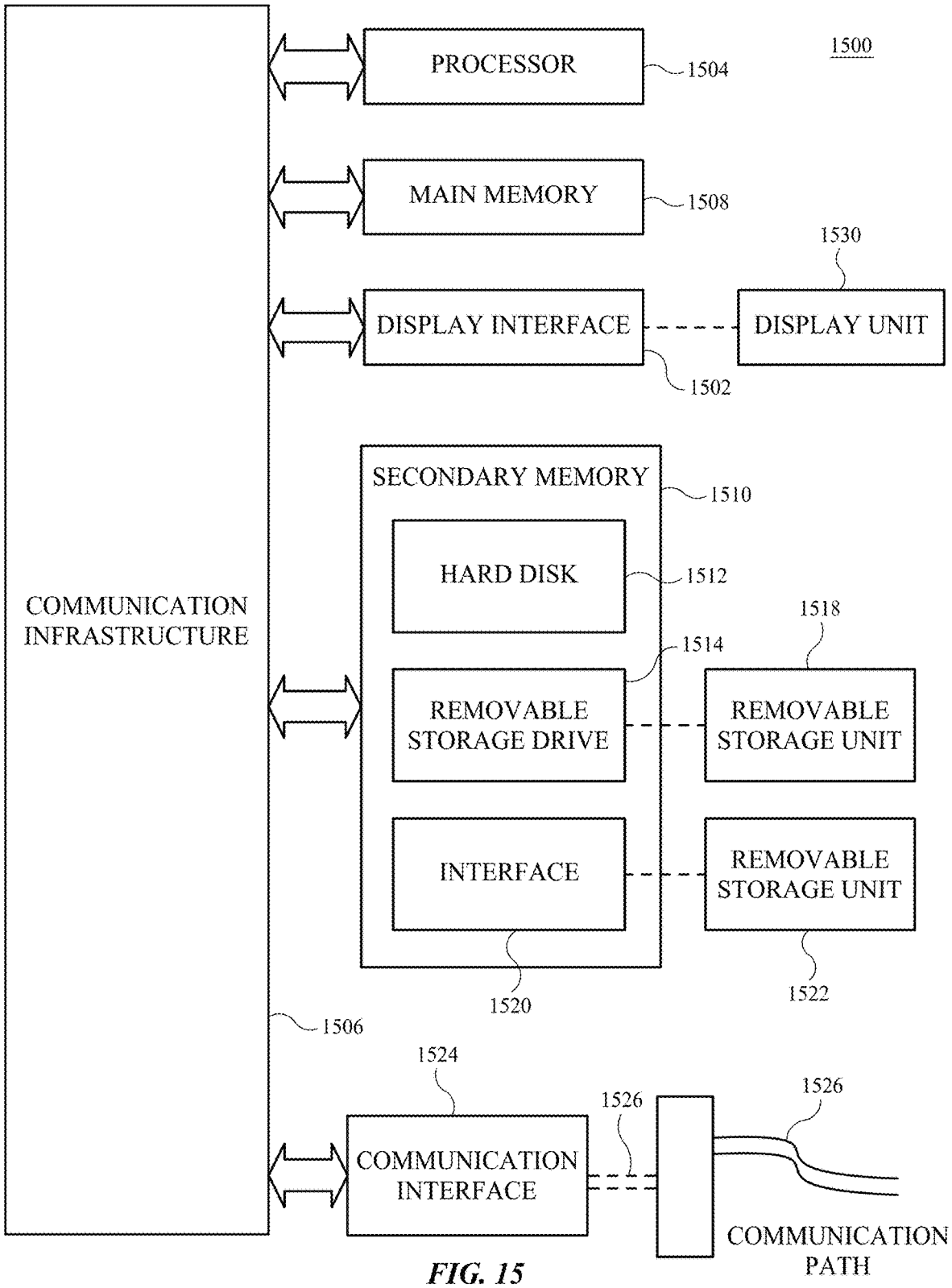
FIG. 15 shows a schematic block diagram of an exemplary computer system in which embodiments may be implemented.

FIG. 15 illustrates an exemplary computer system 1500 in which embodiments, or portions thereof, may be implemented as computer-readable code. For example, portions of controller 720 or server 760 may be implemented in computer system 1500 using hardware, software, firmware, tangible computer readable media having instructions stored thereon, or a combination thereof and may be implemented in one or more computer systems or other processing systems.

If programmable logic is used, such logic may execute on a commercially available processing platform or a special purpose device. One of ordinary skill in the art may appreciate that embodiments of the disclosed subject matter can be practiced with various computer system configurations, including multi-core multiprocessor systems, minicomputers, and mainframe computers, computer linked or clustered with distributed functions, as well as pervasive or miniature computers that may be embedded into virtually any device.

For instance, at least one processor device and a memory may be used to implement the above described embodiments. A processor device may be a single processor, a plurality of processors, or combinations thereof. Processor devices may have one or more processor "cores."

Various embodiments of the inventions may be implemented in terms of this example computer system 1500. After reading this description, it will become apparent to a person skilled in the relevant art how to implement one or more of the inventions using other computer systems and/or computer architectures. Although operations may be described as a sequential process, some of the operations may in fact be performed in parallel, concurrently, and/or in a distributed environment, and with program code stored locally or remotely for access by single or multiprocessor machines. In addition, in some embodiments the order of operations may be rearranged without departing from the spirit of the disclosed subject matter.

Processor device 1504 may be a special purpose or a general purpose processor device. As will be appreciated by persons skilled in the relevant art, processor device 1504 may also be a single processor in a multi-core/multiprocessor system, such system operating alone, or in a cluster of computing devices operating in a cluster or server farm. Processor device 1504 is connected to a communication infrastructure 1506, for example, a bus, message queue, network, or multi-core message-passing scheme.

Computer system 1500 also includes a main memory 1508, for example, random access memory (RAM), and may also include a secondary memory 1510. Secondary memory 1510 may include, for example, a hard disk drive 1512, or removable storage drive 1514. Removable storage drive 1514 may include a floppy disk drive, a magnetic tape drive, an optical disk drive, a flash memory, or the like. The removable storage drive 1514 reads from and/or writes to a removable storage unit 1518 in a well-known manner. Removable storage unit 1518 may include a floppy disk, magnetic tape, optical disk, Universal Serial Bus (USB) drive etc. which is read by and written to by removable storage drive 1514. As will be appreciated by persons skilled in the relevant art, removable storage unit 1518 includes a computer usable storage medium having stored therein computer software and/or data.

Computer system 1500 (optionally) includes a display interface 1502 (which can include input and output devices such as keyboards, mice, etc.) that forwards graphics, text, and other data from communication infrastructure 1506 (or from a frame buffer not shown) for display on display unit 1530.

In alternative implementations, secondary memory 1510 may include other similar means for allowing computer programs or other instructions to be loaded into computer system 1500. Such means may include, for example, a removable storage unit 1522 and an interface 1520. Examples of such means may include a program cartridge and cartridge interface (such as that found in video game devices), a removable memory chip (such as an EPROM, or PROM) and associated socket, and other removable storage units 1522 and interfaces 1520 which allow software and data to be transferred from the removable storage unit 1522 to computer system 1500.

Computer system 1500 may also include a communication interface 1524. Communication interface 1524 allows software and data to be transferred between computer system 1500 and external devices. Communication interface 1524 may include a modem, a network interface (such as an Ethernet card), a communication port, a PCMCIA slot and card, or the like. Software and data transferred via communication interface 1524 may be in the form of signals, which may be electronic, electromagnetic, optical, or other signals capable of being received by communication interface 1524. These signals may be provided to communication interface 1524 via a communication path 1526. Communication path 1526 carries signals and may be implemented using wire or cable, fiber optics, a phone line, a cellular phone link, an RF link or other communication channels.

In this document, the terms "computer program medium" and "computer usable medium" are used to generally refer to media such as removable storage unit 1518, removable storage unit 1522, and a hard disk installed in hard disk drive 1512. Computer program medium and computer usable medium may also refer to memories, such as main memory 1508 and secondary memory 1510, which may be memory semiconductors (e.g. DRAMs, etc.).

Computer programs (also called computer control logic) are stored in main memory 1508 and/or secondary memory 1510. Computer programs may also be received via communication interface 1524. Such computer programs, when executed, enable computer system 1500 to implement the embodiments as discussed herein. In particular, the computer programs, when executed, enable processor device 1504 to implement the processes of the embodiments discussed here. Accordingly, such computer programs represent controllers of the computer system 1500. Where the embodiments are implemented using software, the software may be stored in a computer program product and loaded into computer system 1500 using removable storage drive 1514, interface 1520, and hard disk drive 1512, or communication interface 1524.

Embodiments of the inventions also may be directed to computer program products comprising software stored on any computer useable medium. Such software, when executed in one or more data processing device, causes a data processing device(s) to operate as described herein. Embodiments of the inventions may employ any computer useable or readable medium. Examples of computer useable mediums include, but are not limited to, primary storage devices (e.g., any type of random access memory), secondary storage devices (e.g., hard drives, floppy disks, CD ROMS, ZIP disks, tapes, magnetic storage devices, and optical storage devices, MEMS, nanotechnological storage device, etc.).

The foregoing descriptions of the specific embodiments described herein are presented for purposes of illustration and description. These exemplary embodiments are not intended to be exhaustive or to limit the embodiments to the precise forms disclosed. All specific details described are not required in order to practice the described embodiments.

It will be apparent to one of ordinary skill in the art that many modifications and variations are possible in view of the above teachings, and that by applying knowledge within the skill of the art, one may readily modify and/or adapt for various applications such specific embodiments, without undue experimentation, without departing from the general concept of the present invention. Such adaptations and modifications are intended to be within the meaning and range of equivalents of the disclosed embodiments, based on the teaching and guidance presented herein.

The Detailed Description section is intended to be used to interpret the claims. The Summary and Abstract sections may set forth one or more but not all exemplary embodiments of the present invention as contemplated by the inventor(s), and thus, are not intended to limit the present invention and the appended claims.

The present invention has been described above with the aid of functional building blocks illustrating the implementation of specified functions and relationships thereof. The boundaries of these functional building blocks have been arbitrarily defined herein for the convenience of the description. Alternate boundaries can be defined so long as the specified functions and relationships thereof are appropriately performed.

The phraseology or terminology used herein is for the purpose of description and not limitation, such that the terminology or phraseology of the present specification is to be interpreted by the skilled artisan.

The breadth and scope of the present invention should not be limited by any of the above-described exemplary embodiments, but should be defined only in accordance with the following claims and their equivalents.

What is claimed is:

1. A rotating door system, comprising:

rotatable doors configured to rotate between a closed position and an open position, each respective rotatable door comprising a transparent panel, the transparent panel comprising:

a height measured in a vertical direction between opposing horizontal edges, a width measured in a horizontal direction between opposing vertical edges, and an axis of rotation centrally located between the opposing vertical edges of the transparent panel, wherein each of the rotatable doors is rotatably coupled to an upper support at the axis of rotation via an upper pivot shaft and rotatably coupled to a lower support at the axis of rotation via a lower pivot shaft, wherein the axis of rotation of each rotatable door is fixed relative to the upper support and the lower support, and wherein the rotatable doors do not overlap and are aligned in same plane in the closed position.

2. The rotating door system of claim 1, wherein, when rotating between the closed position and the open position, the rotatable doors automatically rotate at one or both of: the same time and the same speed.

3. The rotating door system of claim 1, wherein, when rotating between the closed position and the open position, each of the rotatable doors automatically rotates at a variable speed between the closed position and the open position, wherein the speed of rotation increases as the rotatable doors rotate away from the closed position, reaches a maximum between the closed position and the open position, and decreases as the rotatable doors approach the open position.

4. The rotating door system of claim 1, wherein, when rotating between the closed position and the open position, a first of the rotatable doors automatically rotates clockwise and a second of the rotatable doors automatically rotates counter-clockwise.

5. The rotating door system of claim 4, wherein the first rotatable door is located immediately adjacent to the second rotatable door.

6. The rotating door system of claim 4, wherein the first rotatable door and the second rotatable door rotate simultaneously.

7. The rotating door system of claim 1, wherein respective rotatable doors immediately adjacent to each other are spaced apart in the closed position.

8. The rotating door system of claim 1, wherein the height of each respective transparent panel is at least 8 feet and the width of each respective transparent panel is at least 6 feet.

9. The rotating door system of claim 1, wherein each respective rotatable door comprises a peripheral border, the peripheral border defining the horizontal edges, the vertical edges, and a border around the periphery of front and rear surfaces of the rotatable door.

10. The rotating door system of claim 9, wherein the upper pivot shaft and the lower pivot shaft of each rotatable door are coupled to the peripheral border of the rotatable door.

11. The rotating door system of claim 1, further comprising a controller configured to control the rotation of the rotatable doors.

12. The rotating door system of claim 11, further comprising a sensor in communication with the controller, wherein the controller is configured to control the rotation of the rotatable doors based on signals received from the sensor.

13. The rotating door system of claim 1, further comprising:

gear assemblies, each respective gear assembly coupled to the upper pivot shaft or the lower pivot shaft of one of the rotatable doors;

actuators, each respective actuator coupled to and configured to rotate one of the gear assemblies; and a controller configured to control the rotation of the rotatable doors by operating the actuators.

14. The rotating door system of claim 1, wherein each respective rotatable door comprises a separate lower support assembly comprising a plate that is fixed relative to the lower support and that rotatably supports the lower pivot shaft of the rotatable door at its axis of rotation.

15. The rotating door system of claim 14, wherein the lower support is a floor, and wherein each respective lower support assembly is directly coupled to the floor.

16. The rotating door system of claim 14, wherein the lower support is a floor, and wherein at least a portion of each respective lower support assembly is disposed within a respective recess in the floor.

17. The rotating door system of claim 14, wherein the separate lower support assembly comprises:

a first plate comprising a lower pivot shaft support, and a second plate secured to the first plate and comprising one or more alignment mechanisms for adjusting the position of the first plate relative to the second plate in a direction perpendicular to the axis of rotation of the rotatable door.

18. The rotating door system of claim 1, wherein the rotatable doors are not coupled to the lower support and the upper support by a frame.

19. The rotating door system of claim 1, wherein each respective rotatable door comprises a separate upper support assembly comprising a plate that is fixed relative to the upper support and that rotatably supports the upper pivot shaft of the rotatable door at its axis of rotation.

20. The rotating door system of claim 19, wherein the upper support is a ceiling, and wherein each respective upper support assembly is directly coupled to the ceiling.

21. The rotating door system of claim 1, wherein the transparent panel defines at least 90% of a front surface area or a rear surface area of the rotatable door.

22. The rotating door system of claim 1, wherein the rotatable doors are configured to close an opening defined by a ceiling, a floor, and side walls of a storefront when the rotatable doors are in the closed position, wherein one of the horizontal edges of each rotatable door is configured to be disposed immediately adjacent the ceiling and the other one of the horizontal edges of each rotatable door is configured to be disposed immediately adjacent the floor when the rotatable doors are in the closed position, and wherein one of the vertical edges of each rotatable door is configured to be disposed immediately adjacent to one of the vertical edges of another door in the rotating door system when the rotatable doors are in the closed position.

23. A store, comprising;

a floor;

a ceiling; and a storefront comprising the rotating door system of claim 1, wherein the axis of rotation of each rotatable door is fixed relative to the storefront.

24. The store of claim 23, further comprising a controller configured to control the rotation of the rotatable doors between the closed position and the open position.

25. The store of claim 23, further comprising:

a controller configured to control the rotation of the rotatable doors between the closed position and the open position; and a sensor in communication with the controller;

wherein the controller is configured to prevent or stop rotation of one or more of the rotatable doors in response to receiving a signal from the sensor.

26. The store of claim 23, further comprising a controller configured to control the rotation of the rotatable doors between the closed position and the open position, wherein the controller is configured to rotate each door having an axis of rotation located to the right of a center of the storefront in a first rotational direction and to rotate each door having an axis of rotation located to the left of the center of the storefront in a second rotational direction opposite the first rotational direction, the right and left being relative to a point of view from outside the store.

27. The store of claim 26, wherein the first rotational direction is clockwise viewed from above, and the second rotational direction is counter-clockwise viewed from above.

28. A rotating door system, comprising:

an upper support;

a lower support;

four rotatable doors, each respective rotatable door comprising: a transparent panel and a vertical axis of rotation extending centrally within the transparent panel; and a controller configured to control the rotation of the rotatable doors about their respective vertical axes of rotation between a closed position and an open position, wherein the axis of rotation of each rotatable door is fixed during rotation of the rotatable doors, wherein the four rotatable doors are disposed side-by-side in the closed position, wherein vertical edges of respective adjacent rotatable doors are spaced apart from each other and do not overlap when the four rotatable doors are in the closed position, and wherein the controller is configured rotate a left-most two rotatable doors of the rotatable doors in a first rotational direction and is configured to rotate a right-most two rotatable doors of the rotatable doors in a second rotational direction opposite the first rotational direction.

29. The rotating door system of claim 28, wherein vertical edges of respective adjacent rotatable doors are disposed immediately adjacent to each other when the four rotatable doors are in the closed position.

30. The rotating door system of claim 28, wherein the four rotatable doors are configured to rotate clockwise and counterclockwise.

31. The rotating door system of claim 28, wherein each respective rotatable door comprises a separate actuator controllable by the controller to rotate the rotatable doors about their respective axes of rotation.

32. A storefront having an opening defined by a ceiling, a floor, and side walls, the storefront comprising:

a door system that occupies the opening, the door system comprising:

rotatable doors that rotate between an open position and a closed position, the rotatable doors being positioned side-by-side and in-line with one another when in the closed position such that the rotatable doors prevent access through the opening, and the rotatable doors being positioned parallel one another when in the open position such that the rotatable doors allow access through the opening, wherein each of the rotatable doors comprises a centrally located axis of rotation that is at a fixed location within the opening and that is defined by: an upper pivot point positioned relative to the ceiling and a lower pivot point positioned relative to the floor, wherein each of the rotatable doors is configured to rotate about its respective centrally located axis of rotation between the closed position and the open position, wherein each of the rotatable doors comprises a top horizontal edge disposed immediately adjacent the ceiling and a bottom horizontal edge disposed immediately adjacent the floor when the rotatable doors are in the closed position, wherein each of the rotatable doors comprises a transparent panel extending continuously between the horizontal edges and the vertical edges of the rotatable door, and wherein two of the rotatable doors each comprises: a first vertical edge disposed immediately adjacent to a vertical edge of another one of the rotatable doors when the rotatable doors are in the closed position, and a second vertical edge disposed immediately adjacent to a side wall of the storefront when the rotatable doors are in the closed position.

33. The storefront of claim 32, wherein each adjacent pair of the rotatable doors defines a walkway when the adjacent pair of the rotatable doors is in the open position.

34. The storefront of claim 32, wherein the entranceway comprises a horizontal center, wherein respective rotatable doors having an axis of rotation located to the left of the horizontal center are configured to rotate in a first rotational direction, and wherein respective rotatable doors having an axis of rotation located to the right of the horizontal center are configured to rotate in a second rotational direction opposite the first rotational direction.

35. The storefront of claim 32, wherein the rotatable doors span across at least 75% of the storefront when the rotatable doors are in the closed position.

36. The rotating door system of claim 32, wherein the transparent panel defines at least 90% of a front surface area or a rear surface area of the rotatable door.

37. The rotating door system of claim 32, wherein each rotatable door of the rotatable doors comprises a peripheral border, and the peripheral border defines the horizontal edges and the vertical edges of the rotatable door.

* * * * *